US007409918B2

(12) United States Patent
Fujihara et al.

(10) Patent No.: US 7,409,918 B2
(45) Date of Patent: Aug. 12, 2008

(54) WALKING FOOT FOR SEWING MACHINE

(75) Inventors: Shinya Fujihara, Ichinomiya (JP); Tomoyasu Niizeki, Inazawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/790,231

(22) Filed: Apr. 24, 2007

(65) Prior Publication Data

US 2007/0266920 A1 Nov. 22, 2007

(30) Foreign Application Priority Data

May 22, 2006 (JP) ..... 2006-141292

(51) Int. Cl.
*D05B 27/04* (2006.01)
*D05B 29/12* (2006.01)

(52) U.S. Cl. ..... 112/320; 112/240

(58) Field of Classification Search ..... 112/311, 112/312, 320, 323, 235, 236, 237, 238, 239, 112/240

See application file for complete search history.

(56) References Cited

U.S. PATENT DOCUMENTS

| | | | | |
|---|---|---|---|---|
| 2,742,009 | A * | 4/1956 | Enos | 112/235 |
| 3,730,117 | A * | 5/1973 | Ritter et al. | 112/320 |
| 3,734,041 | A * | 5/1973 | Casas | 112/320 |
| 3,933,106 | A * | 1/1976 | Murray | 112/235 |
| 4,212,256 | A | 7/1980 | Jimenez | |
| 4,580,516 | A * | 4/1986 | Dreier | 112/311 |
| 4,646,668 | A * | 3/1987 | Biermann et al. | 112/320 |
| 4,724,783 | A | 2/1988 | Morimoto | |
| 5,097,778 | A * | 3/1992 | Niino | 112/311 |
| 5,749,311 | A * | 5/1998 | Kobayashi et al. | 112/240 |
| 5,911,184 | A * | 6/1999 | Tayrien et al. | 112/136 |

FOREIGN PATENT DOCUMENTS

| | | |
|---|---|---|
| JP | A-03-143475 | 6/1991 |
| JP | A-10-108988 | 4/1998 |

* cited by examiner

*Primary Examiner*—Ismael Izaguirre
(74) *Attorney, Agent, or Firm*—Oliff & Berridge, PLC

(57) ABSTRACT

A walking foot for a sewing machine includes a presser foot having a pair of supported portions, an upper feed dog feeding workpiece cloth in synchronization with vertical movement of a needlebar, a supporting member fixed to a lower end of the presser bar and having a pair of engagement supporting portions supporting the presser foot, a swinging supporting mechanism engaging the engagement supporting portions with the supported portions from horizontally outside respectively so that the presser foot is supported on the supporting member so as to be swingable, and a disengaging mechanism moving at least one of the engagement supporting portions horizontally outward from an engagement position where the engagement supporting portion is in engagement with the supported portion of the presser foot, thereby being capable of switching the engagement supporting portion to a disengagement position where the engagement supporting portion is disengaged from the supported portion.

11 Claims, 24 Drawing Sheets

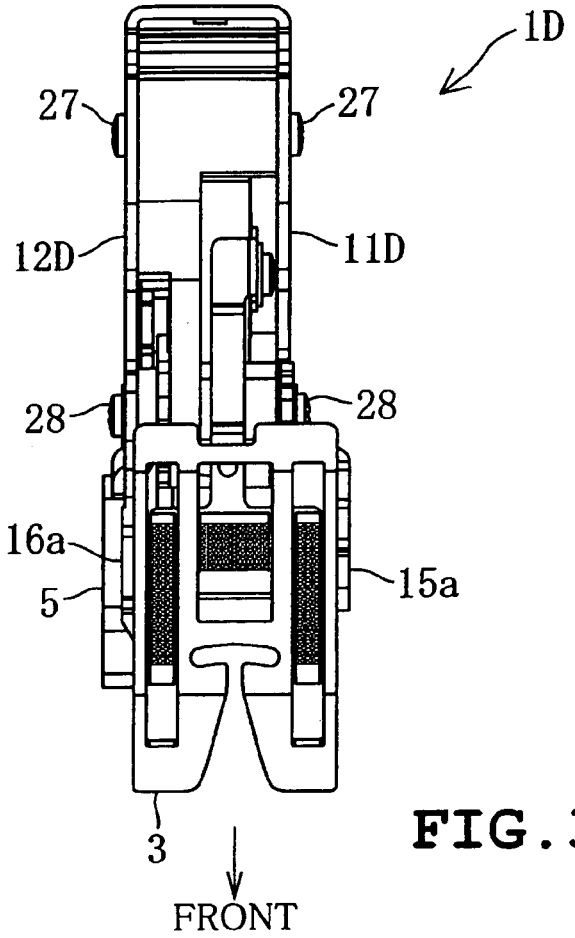
FIG.32
FIG.33
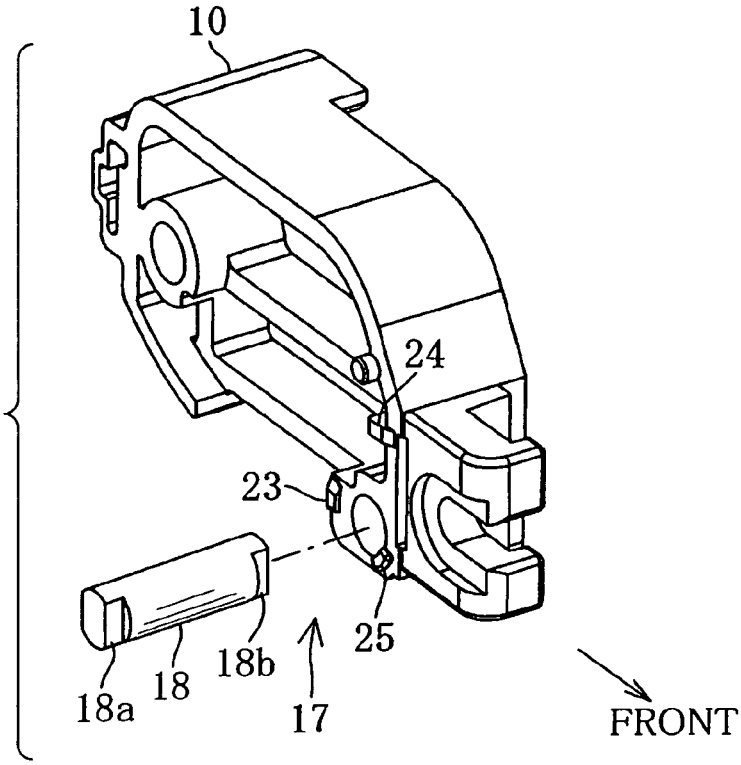

WALKING FOOT FOR SEWING MACHINE

CROSS-REFERENCE TO RELATED APPLICATIONS

This application is based upon and claims the benefit of priority from the prior Japanese Patent Application No. 2006-141292 filed on May 22, 2006, the entire contents of which are incorporated herein by reference.

BACKGROUND

1. Technical Field

The present disclosure relates to a walking foot which is attached to a lower end of a presser bar in a sewing machine so as to be located at an upper side of workpiece cloth, thereby feeding the workpiece cloth placed at an upper side of a needle plate in synchronization with a feed dog provided on a sewing bed.

2. Description of the Related Art

In quilting, two pieces of workpiece cloth are sewn so as to be combined together with cotton being stuffed therebetween using a sewing machine. In this case, an operator conventionally attaches a walking foot to a lower end of a presser bar of the sewing machine so that the upper workpiece cloth is fed by the walking foot in synchronization with the lower workpiece cloth, whereupon the upper workpiece cloth can be prevented from sewing slippage relative to the lower workpiece cloth.

For example, JP-A-H03-143475 discloses a cloth feeding device for a sewing machine comprising a holder having side plates covering right and left sides thereof, an operating lever which is mounted on the holder so as to be vertically movable, an upper feed dog mounted on the holder and a presser foot which is mounted on an engagement shaft supported on arm portions of side plates so as to be swingable. In quilting, the operating lever is swung upward in synchronization with rise of the needle bar so that the upper feed dog is lowered thereby to press the workpiece cloth from above. In this state, the upper feed dog is actuated to feed the upper workpiece cloth in synchronization with a lower feed dog, whereupon the upper workpiece cloth can be prevented from sewing slippage relative to the lower workpiece cloth.

It is desired that a plurality of types of presser feet used in the walking foot should be prepared according to sewing manners of quilting and types of workpiece cloth so that sewing can be carried out while the presser foot is changed by the operator to a suitable one according to a sewing manner and a type of workpiece cloth. In the above-described cloth feeding device, however, the side plates have the right and left arm portions supporting the presser bar at both sides of the latter so that the presser bar is swung. Since the side plates are fixed to the holder, there is a problem that the presser foot cannot be changed to another one.

SUMMARY

Therefore, an object of the present disclosure is to provide a walking foot for the sewing machine, which has a simple structure and includes a presser foot which can be replaced by another one easily and quickly.

The present disclosure provides a walking foot for a sewing machine including a needlebar movable vertically. The walking foot is detachably attached to a lower end of a presser bar and comprises a presser foot provided with a pair of right and left engagement supported portions, an upper feed dog feeding workpiece cloth in synchronization with vertical movement of the needlebar, a supporting member fixed to the lower end of the presser bar and provided with a pair of right and left engagement supporting portions supporting the presser foot, a swing supporting mechanism which engages the engagement supporting portions of the supporting member with the engagement supported portions of the presser foot from horizontally outside respectively so that the presser foot is supported on the supporting member so as to be swingable, and a disengaging mechanism which moves at least one of the engagement supporting portions horizontally outward from an engagement position where said at least one engagement supporting portion is in engagement with the engagement supported portion of the presser foot, thereby being capable of switching said at least one engagement supporting portion to a disengagement position where said at least one engagement supporting portion is disengaged from the engagement supported portion of the presser foot.

In the above-described construction, the disengaging mechanism is capable of moving at least one engagement supporting portion horizontally outward from an engagement position where the engagement supporting portion is in engagement with the engagement supported portion of the presser foot to the disengagement position where the engagement supporting portion is disengaged from the engagement supported portion of the presser foot. Accordingly, the presser foot can easily be disengaged from the engagement support portion of the supporting member thereby to be detached from the supporting member when at least one engagement supporting portion is just moved horizontally outward from the engagement position to the disengagement position. Furthermore, the direction in which the engagement supporting portion is switched between the engagement position and the disengagement position is horizontal, whereas pressing load is applied vertically to the presser foot. Accordingly, the engagement supporting portion can be prevented from being switched from the engagement position to the disengagement position by the action of the pressing load. More specifically, the engagement supporting portion can reliably be held at the engagement position during sewing.

The disclosure also provides a walking foot for a sewing machine including a needlebar movable vertically. The walking foot is detachably attached to a lower end of a presser bar and comprises a presser foot provided with a pair of engagement supported portions, an upper feed dog feeding workpiece cloth in synchronization with a vertical movement of the needlebar, a supporting member fixed to the lower end of the presser bar and provided with a pair of engagement supporting portions supporting the presser foot, a swing supporting mechanism which engages the engagement supporting portions of the supporting member with the engagement supported portions of the presser foot from horizontally outside respectively so that the presser foot is supported on the supporting member so as to be swingable, and a disengaging mechanism capable of switching at least one of the engagement supporting portions from an engagement position where said at least one engagement supporting portion is in engagement with the engagement supported portion of the presser foot to a disengagement position where said at least one engagement supporting portion is disengaged from the engagement supported portion of the presser foot.

In the above-described construction, the presser foot can be disengaged from the engagement support portion of the support when at least one engagement support portion is just switched from the engagement position where the engagement supporting portion is in engagement with the engagement supported portion to the disengagement position where the engagement supporting portion is disengaged from the engagement supported portion. Consequently, the presser foot can easily be detached from the supporting member.

BRIEF DESCRIPTION OF THE DRAWINGS

Other objects, features and advantages of the present disclosure will become clear upon reviewing the following description of the illustrative example with reference to the accompanying drawings, in which:

FIG. 32 is a bottom view of the sewing machine walking foot;

FIG. 33 is a perspective view of a holder;

DETAILED DESCRIPTION

Figure 1:
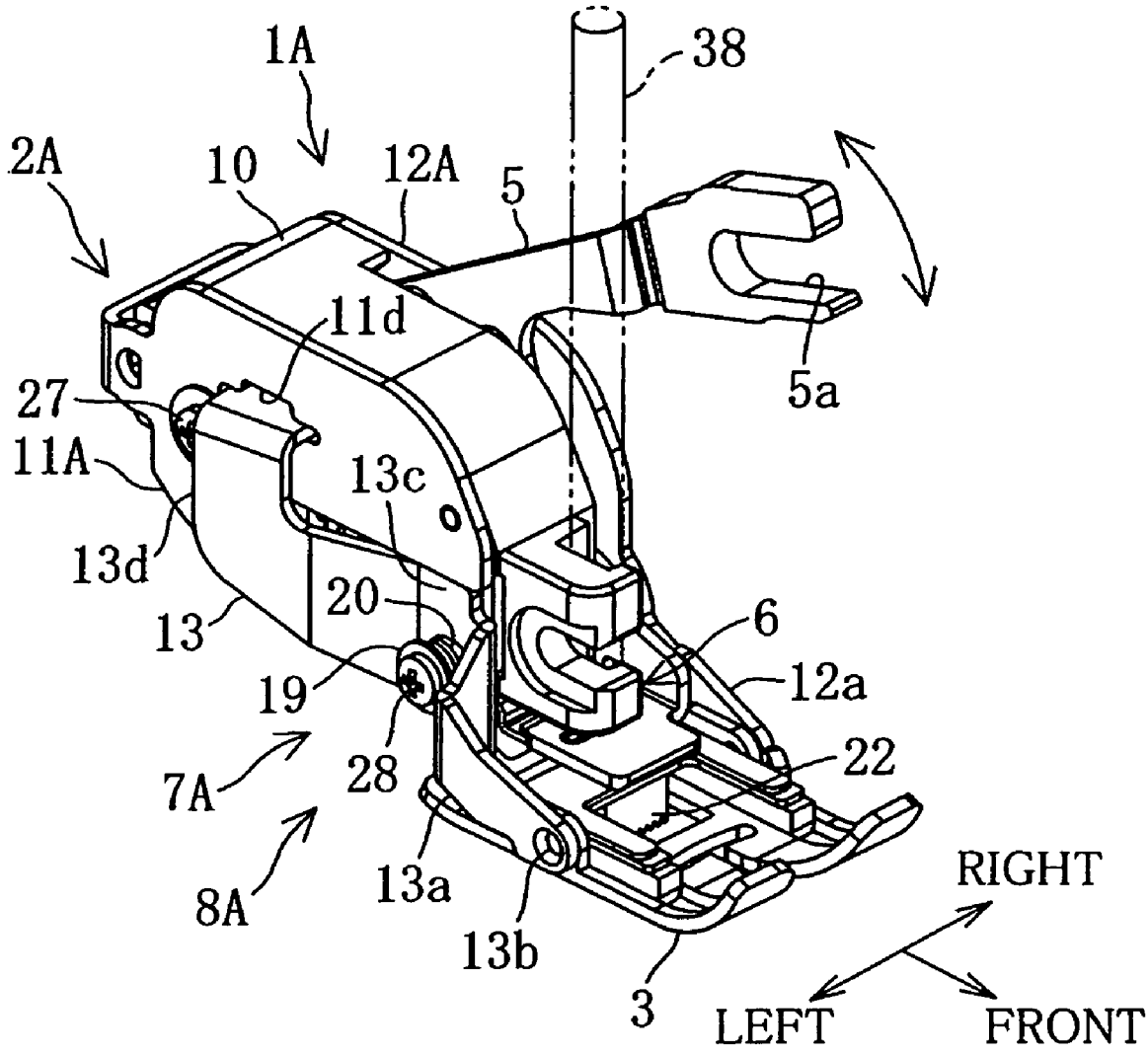
FIG. 1 is a perspective view of a sewing machine walking foot of one illustrative example of the present disclosure.

A first illustrative example of the present disclosure will be described with reference to FIGS. 1 to 7 and 40 to 43. Firstly, a sewing machine 30 to which a walking foot of the illustrative example is detachably attached. The sewing machine 30 includes a sewing bed 31, a pillar 32 extending upward from a right end of the bed 31, a sewing arm 33 extending leftward from an upper part of the pillar 32 and a head 34 provided on the left end side of the arm 33 as shown in FIG. 43. A needle plate 35 is mounted on an upper face of the bed 31. A sewing machine main shaft driven by a sewing machine motor is provided in the arm 34 although neither sewing machine main shaft nor sewing machine motor is shown. A needlebar 36 driven by the sewing machine main shaft is attached to the head 34 so as to be moved vertically. The needlebar 36 has a lower end to which a sewing needle 37 is attached. Furthermore, a presser bar 38 is attached to the head 34 so as to be raised and lowered. The presser bar 38 is located in the rear of the needlebar 36 and driven by the sewing machine motor. The presser bar 38 has a lower end to which a cloth presser 39 is mounted.

A sewing machine walking foot 1A is detachably attached by a screw (not shown) to the lower end of the presser bar 38 from which the cloth presser 39 has been detached. The walking foot 1A includes a presser foot 3 which will be described later. Quilting cloth made by sandwiching cotton between two pieces of workpiece cloth is adapted to be fed by an upper feed dog 22 in cooperation with a (lower) feed dog (not shown) provided on the bed 31 without slippage of the workpiece cloth pieces while being pressed against an upper side of the needle plate 35 by the presser foot 3 of the walking foot 1A. Thus, the walking foot 1A is used particularly in quilting in which two pieces of workpiece cloth are sewn together with cotton being sandwiched therebetween. Accordingly, a plurality of types of presser feet 3 used in the walking foot 1A are prepared according to modes of the quilting. The operator then carries out sewing while replacing the presser foot by one suitable for a quilting mode.

Figure 40:
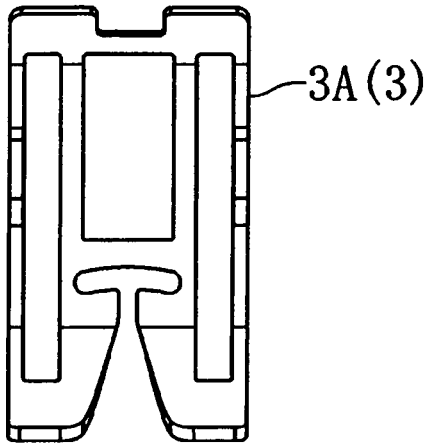
FIG. 40 is a plan view of the presser foot for the zigzag sewing.
Figure 41:
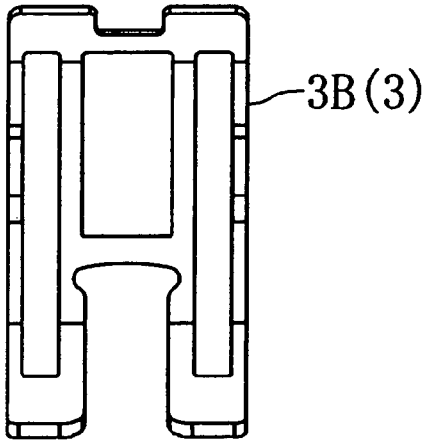
FIG. 41 is a plan view of the open toe type.
Figure 42:
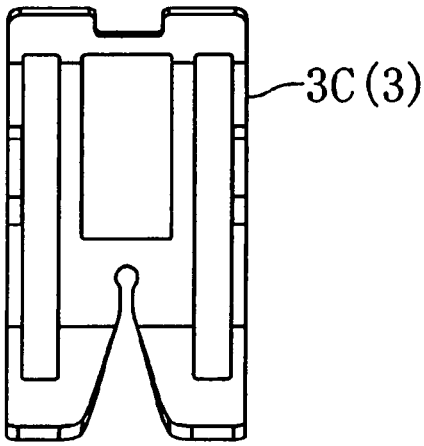
FIG. 42 is a plan view of a presser foot for a straight sewing.
Figure 43:
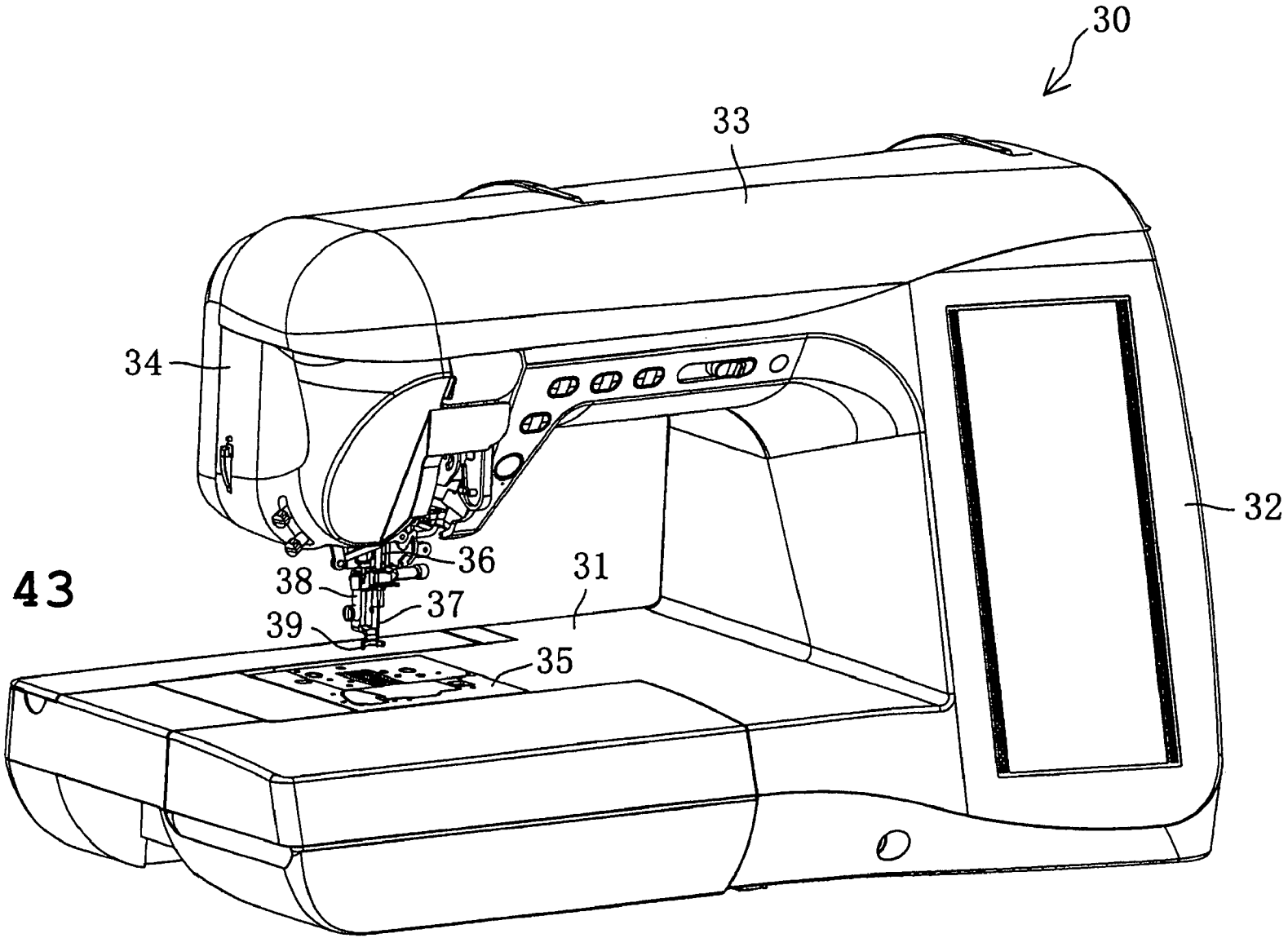
FIG. 43 is a perspective view of the sewing machine.

The plural types of presser feet 3 includes, for example, a presser foot 3A for zigzag sewing as shown in FIG. 40, an open-toe presser foot 3B as shown in FIG. 41 and a presser foot 3C for straight sewing as shown in FIG. 42. The open-toe presser foot 3B has an open front of a needle location hole in order that a needle location of the sewing needle may easily be viewed. And otherwise, a presser foot has a cloth-pressing surface to which a surface treatment has been applied for reduction in friction between workpiece cloth and the cloth-pressing surface although not shown. Further, a presser foot made from a transparent resin is prepared in order that a needle location may be viewed more easily.

Figure 2:
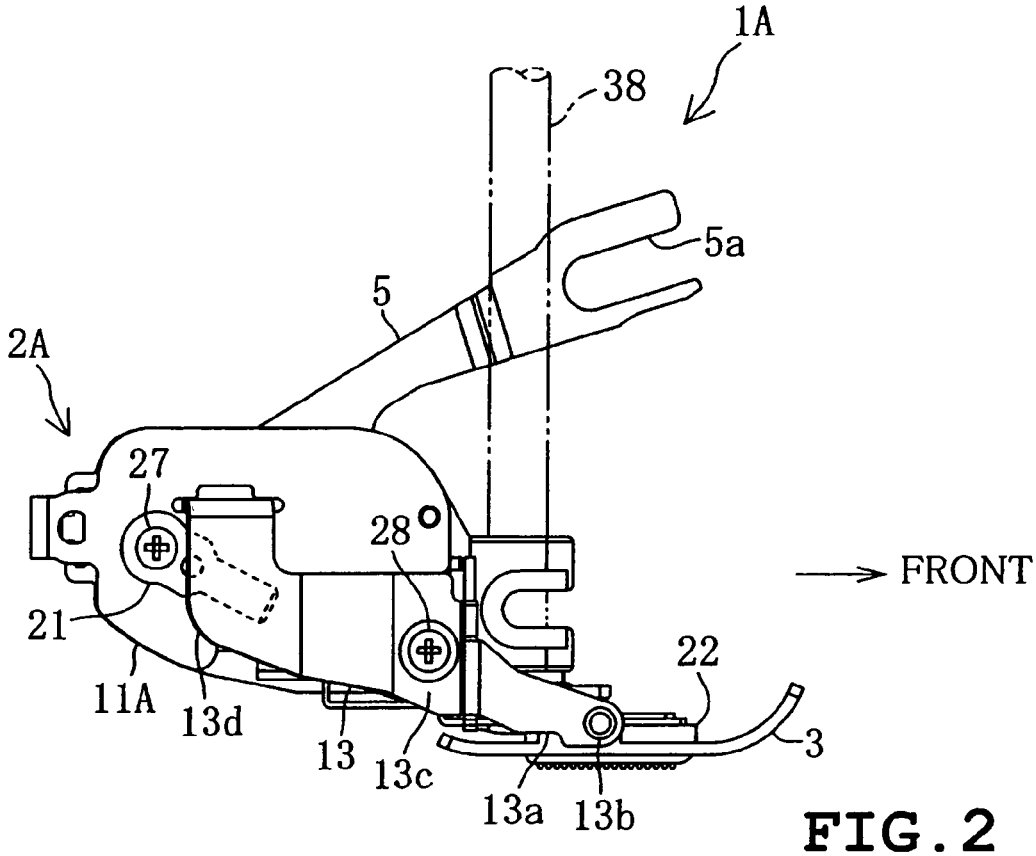
FIG. 2 is a left longitudinal section of the sewing machine walking foot.

The walking foot 1A is basically constructed in the same manner as conventional walking feet and includes a supporting member 2A which is a body thereof, the presser foot 3, a swing lever 5 having a distal end including a forked part 5*a*, a cloth feeding mechanism 6, a swing supporting mechanism 7A, a disengaging mechanism 8A. The supporting member 2A includes a holder 10, a pair of right and left side plates 11A and 12A and a lever 13. The left side plate 11A is sized so as to cover substantially an entire left side of the holder 10 and detachably fixed by a first fixing screw 27 to the left side of the holder 10 as shown in FIGS. 1 and 2. The left side plate 11A has a front end provided with the lever 13 which is swingable horizontally. The lever 13 is formed substantially into the shape of a crank as viewed on a plane as shown in FIGS. 1, 2, 5 and 6. More specifically, the lever 13 has a front end having a left engagement arm 13*a* formed integrally therewith. The left engagement arm 13*a* has a front end (distal end) formed with a left engagement pin 13*b* protruding rightward and serving as an engagement support portion. The lever 13 further has a fulcrum 13*c* formed at a lengthwise middle thereof and a rear end (proximal end) formed with an operating portion 13*d*. The lever 13 is supported at the fulcrum 13*c* on a left end of a support shaft 18 extending through the holder 10 in the right-left direction.

A washer 19 is fixed to the left end of the support shaft 18 by a second fixing screw 28. The support shaft 18 includes a part protruding leftward from the lever 13. A coil spring 20 is provided about the protruding part of the support shaft 18 so as to be located between the washer 19 and the fulcrum 13*c*. Accordingly, the fulcrum 13*c* is usually pressed against the left side plate 11A by the coil spring 20. The operating portion 13*d* of the lever 13 is formed with a horizontal bent portion a part of which is fitted in a front-rear directed slit lid formed in the left side plate 11A. Since the lever 13 is held so as to be impossible to rotate about the support shaft 18 as the result of engagement of the horizontal bent portion with the left-side plate 11A, the left engagement pin 13*b* is held stably at the engagement position.

Figure 6:
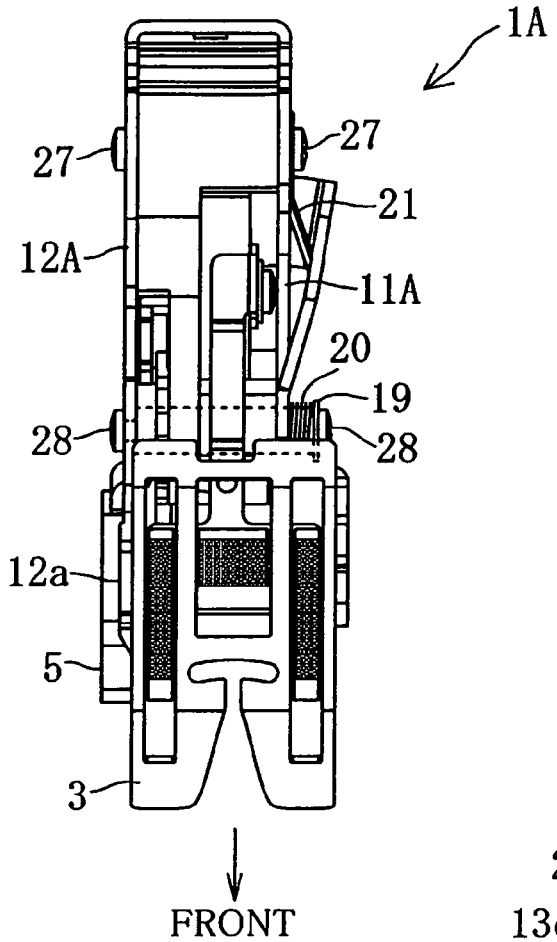
FIG. 6 is a bottom view of the sewing machine walking foot.
Figure 7:
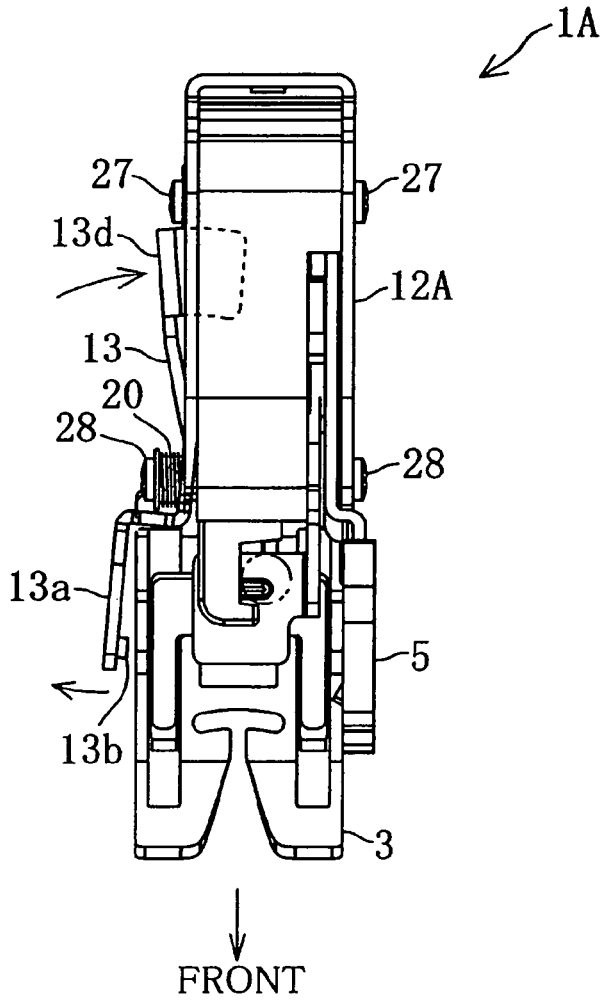
FIG. 7 is a view similar to FIG. 5, showing the case where a presser foot is replaced by another.

Furthermore, a thin plate-shaped leaf spring 21 is disposed between the operating portion 13*d* of the lever 13 and the left side plate 11A as shown in FIGS. 2 and 6. The leaf spring 21 has a rear end fixed to the left side plate 11A by the first fixing screw 27. Accordingly, since the operating portion 13*d* is usually urged by the leaf spring 21 in such a direction that the operating portion is spaced away from the left side plate 11A, the left engagement pin 13*b* of the lever 13 is engageable with a left engagement hole 3*g* of a presser foot 3 thereby to be held in the left engagement hole.

Figure 3:
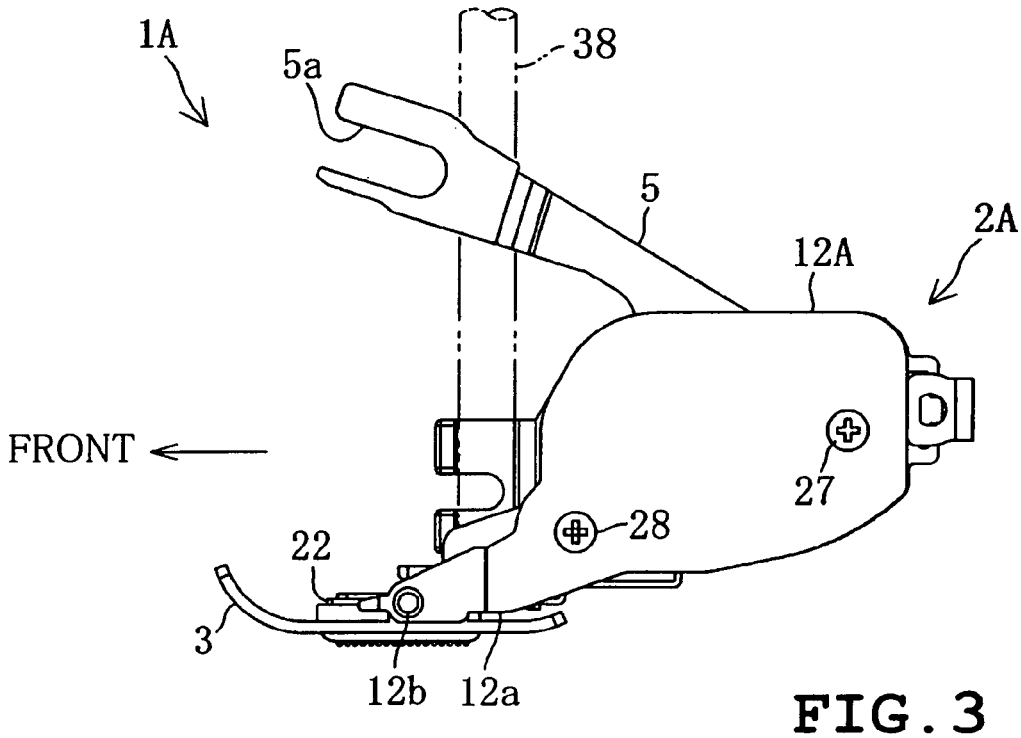
FIG. 3 is a right longitudinal section of the sewing machine walking foot.

A right side plate 12A comprises a single plate member and includes a rear end as shown in FIGS. 1 and 3. The right side plate 12A is detachably attached at the rear end and the middle in the front-rear direction to a right side of the holder 10 by the first and second fixing screws 27 and 28. The right side plate 12A has a front end on which a right engagement arm 12*a* is formed integrally. The right engagement arm 12*a* has a distal or front end provided with a right engagement pin 12*b* serving as an engagement support 12*b* and protruding leftward.

Figure 4:
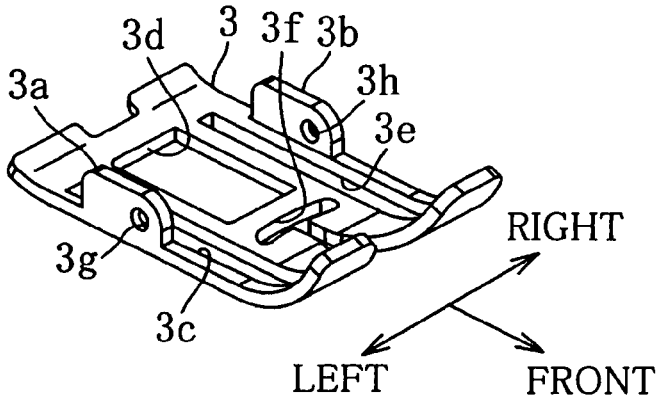
FIG. 4 is a perspective view of a presser foot.
Figure 5:
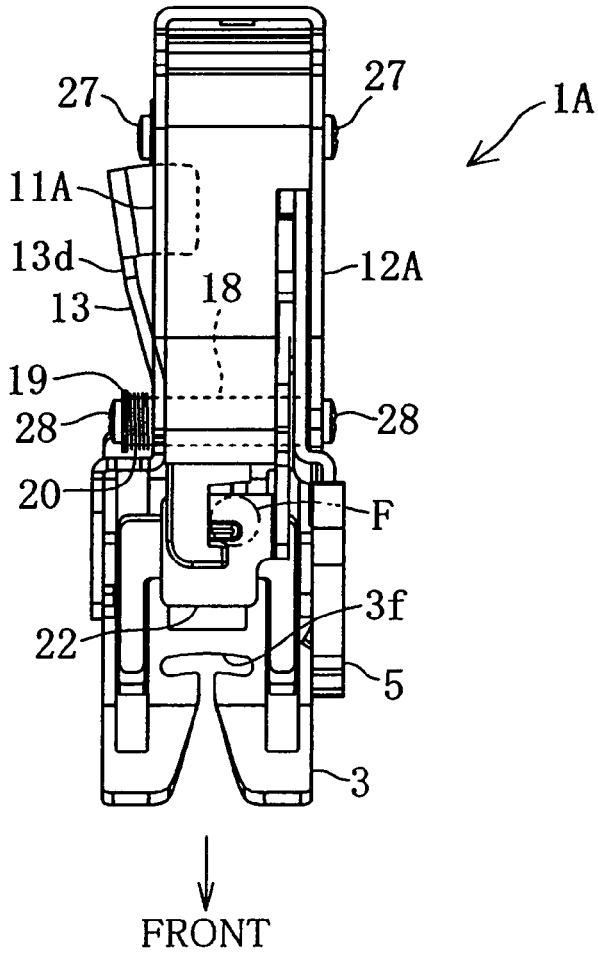
FIG. 5 is a plan view of the sewing machine walking foot.

The presser foot 3 is constructed substantially in the same manner as cloth pressers of general sewing machines. More specifically, the presser foot 3 includes a pair of right and left engaged portions 3*a* and 3*b* standing thereon, three notches 3*c* to 3*e* in which the upper feed dog 22 of the cloth feed mechanism 6 is capable of being fitted and an arc needle hole 3*f*, as shown in FIG. 4. The engaged portions 3*a* and 3*b* of the presser foot 3 have right and left engagement holes 3*g* and 3*h* serving as engagement supported portions respectively. The engagement pins 13*b* and 12*b* of the aforesaid engagement arms 13*a* and 12*a* are engageable with the corresponding engagement holes 3*g* and 3*h* respectively. Thus, the engagement pins 13*b* and 12*b* of the engagement arms 13*a* and 12*a* are usually in engagement with the engagement holes 3*g* and 3*h* formed in the presser foot 3, thereby assuming engagement positions, respectively. A swing supporting mechanism 7A is composed of the lever 13, right side plate 12A, the paired engagement pins 13*b* and 12*b*, leaf spring 21 and the like. A disengaging mechanism 8A is composed of the lever 13 and the like.

The swing lever 5 has a proximal end at which the swing lever is supported on a shaft (not shown) provided in the holder 10 so as to be swingable vertically. The forked portion 5*a* of the swing lever 5 is adapted to be connected to a shaft of a needlebar connecting stud (not shown) fixed to the needlebar 36. The cloth feed mechanism 6 includes a transmission lever (not shown) which is supported on the holder so as to be swingable and an upper feed dog 22 which is provided on the holder 10 so as to be pressed downward by a distal end of the transmission lever. The transmission lever is adapted to be operated in conjunction with the swing lever 5. The upper feed dog 22 is adapted to be urged upward by a spring (not shown).

The operation of the cloth feeding mechanism 6 will now be described in brief. When the needlebar 36 is raised and the swing lever 5 is swung upward, the transmission lever is caused to pivot downward in conjunction with the swing lever 5 so that the distal end of the transmission lever presses the upper feed dog 22 downward from the notches 3*c* to 3*e* of the presser foot 3 such that the workpiece cloth is sandwiched by the upper feed dog 22 and the (lower) feed dog protruding upward (not shown) from the needle plate 35. Subsequently, the upper feed dog 22 is moved horizontally rearward together with the (lower) feed dog (cloth feed). Upon completion of the cloth feed, the needlebar 36 is lowered and the swing lever 5 is caused to pivot downward. The transmission lever is caused to pivot upward in conjunction with the downward pivot of the swing lever 5. As a result, since the upper feed dog 22 is released from a pressing force of the transmission lever, the upper feed dog 22 is raised by the urging force of the spring member and then moved frontward thereby to be returned to the reference position. In this case, the overall walking foot 1A is lowered by the presser bar 38 such that the presser foot 3 presses the workpiece cloth, whereby the workpiece cloth is sandwiched between the presser foot 3 and the needle plate 35. In this state, one stitch is carried out by the sewing needle 37.

The following describes the operation of the walking foot 1A constructed as described above. When replacing the presser foot 3 by another in quilting, the operator firstly presses the operating portion 13*d* of the lever 13 on the left side plate 11A side (clockwise as viewed in FIG. 7) against the spring force of the leaf spring 21. As a result, since the lever 13 pivots about the fulcrum 13*c* clockwise, the left engagement pin 13*b* provided on the distal end of the left engagement arm 13*a* is moved horizontally outward (leftward) thereby to be switched to a disengagement position. In this case, the left engagement pin 13*b* is disengaged from the left engagement hole 3*b* such that the presser foot 3 can be detached. The operator then prepares the another presser foot 3 and fits the right engagement pin 12*b* in the right engagement hole 3*h* while depressing the operating portion 13*d*. The operating portion 13*d* is released from depression under the condition where the left engagement hole 3*g* of the presser foot 3 is positioned so as to correspond to the left engagement pin 13*b*. As a result, the left engagement pin 13*b* is fitted in the left engagement hole 3*g*, whereby the replacement of the presser foot 3 is completed.

As obvious from the foregoing, the walking foot 1A includes the supporting member 2A provided with the paired engagement pins 13*b* and 12*b* fixed to the lower end of the presser bar 38 and supporting the presser foot 3, the swing supporting mechanism 7A engaging the engagement pins 13*b* and 12*b* with the paired engagement holes 3*g* and 3*h* of the presser foot 3 from horizontally outward thereby to support the presser foot 3 on the supporting member 2A so that the presser foot 3 is swingable and the disengaging mechanism 8A moving the left engagement pin 13*b* horizontally outward from the engagement position where the engagement pin 13*b* is in engagement with the left engagement hole 3*g* and capable of switching the left engagement pin 13*b* to the disengagement position where the left engagement pin 13*b* is out of engagement with the left engagement hole 3*g*. The supporting member 2A includes the lever 13 having the left engagement pin 13*b* provided on the distal end thereof, the fulcrum 13*c* provided in the lengthwise middle and the operating portion provided on the proximal end thereof and the left side plate 11A. The disengaging mechanism 8A is constructed so as to switch the left engagement pin 13*b* from the engagement position to the disengagement position via the fulcrum 13*c* when the operating portion 13*d* is pressed to the left side plate 11A side. Consequently, the operator can detach the presser foot 3 easily and quickly from the supporting member 2A via the disengaging mechanism 8A when only pressing the operating portion 13*d* of the lever 13 to the left side plate 11A side.

Modified forms of the illustrative example will be described. The right side plate 12A may also be provided with a lever, which may be provided with the right engagement pin in the same manner as the left side plate 11A. In this case, the operator simultaneously presses the paired levers in replacement of the pressure foot 3. The left lever 13 may be eliminated and thus, only the right lever may be provided. The leaf-spring 21 may be fixed to the lever 13 by a screw. Furthermore, welding or adhesive may be used for fixing the leaf spring 21 instead of the screw. The lever 13 may be provided with a vertically extending support shaft on the fulcrum 13*c* and supported by the support shaft so as to be swingable horizontally.

A second illustrative example of the disclosure will be described with reference to FIGS. 8 to 14. A walking foot 1B basically has the same construction as the walking foot 1A of the first illustrative example. Identical or similar parts in the second illustrative example are labeled by the same reference symbols as those in the first illustrative example. The walking foot 1B comprises the supporting member 2B serving as the body, presser foot 3, screw 4, swing lever 5, cloth feeding mechanism 6, swing supporting mechanism 7B, disengaging mechanism 8B or the like.

The supporting member 2B comprises the holder 10 and a pair of right and left side plates 11B and 12B mounted on right and left sides of the holder 10, respectively. The left side plate 11B comprises a single plate-shaped member and fixed at the rear end and the middle in the front-rear direction to the left side of the holder 10 by first and second fixing screws 27 and 28 respectively. The left engagement arm 11*a* is formed integrally with the front end of the left side plate 11B. A screw hole 11*c* (see FIG. 14) is formed in the front end (distal end) of the left engagement arm 11*a*.

Figure 8:
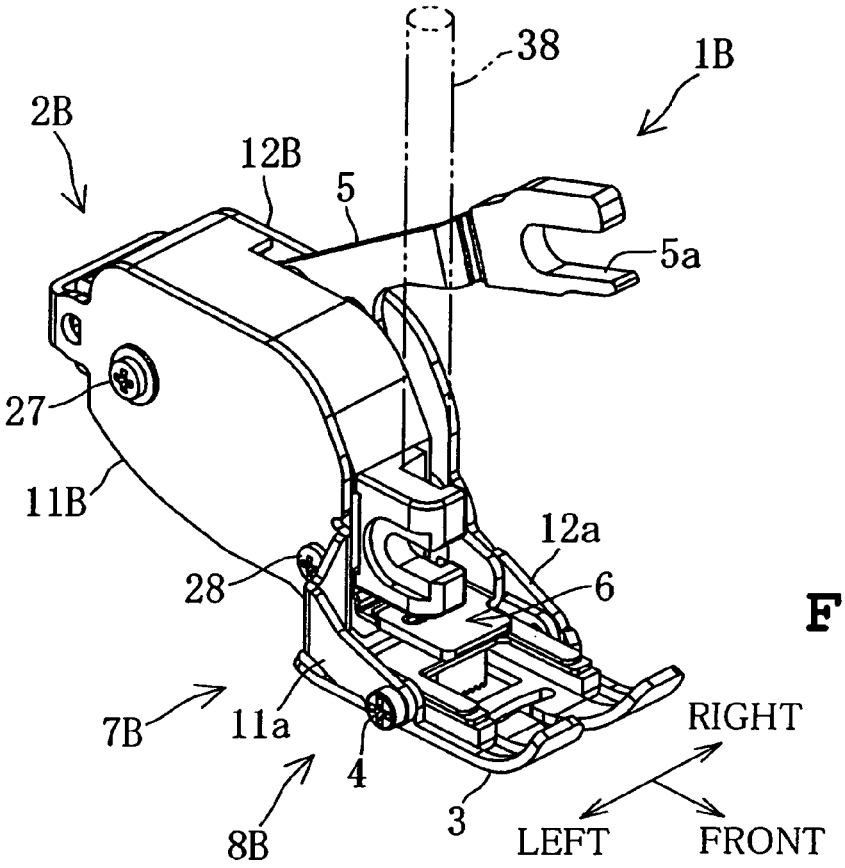
FIG. 8 is a perspective view of the sewing machine walking foot of a second illustrative example in accordance with the disclosure.
Figure 9:
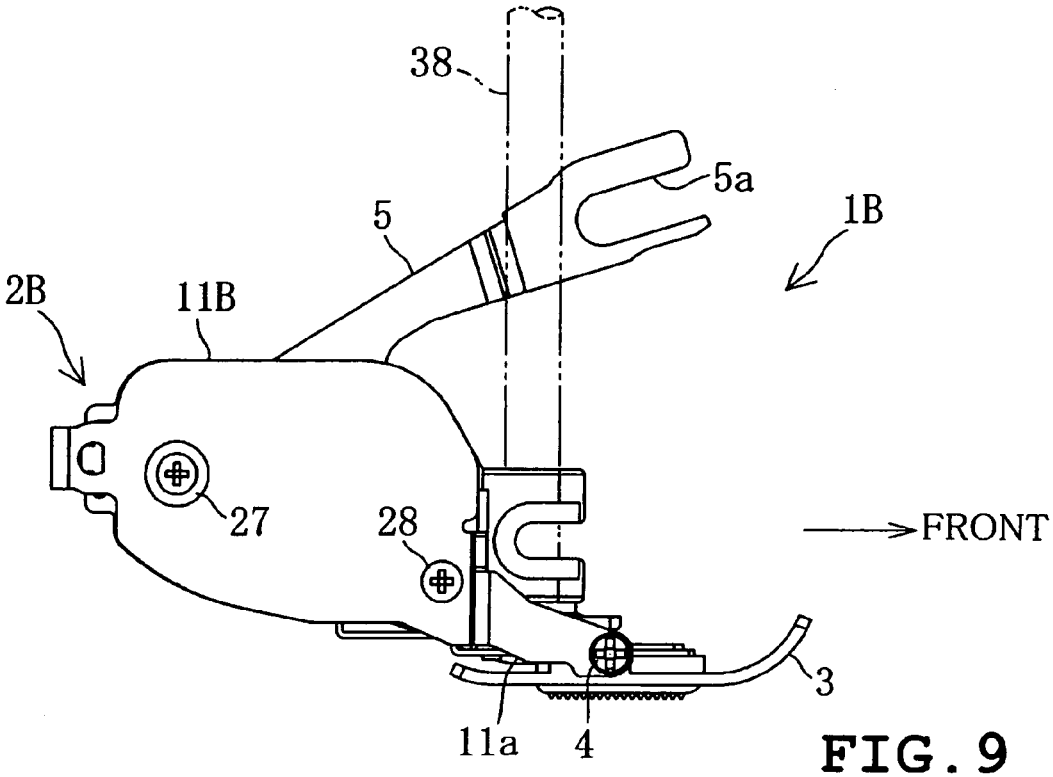
FIG. 9 is a left side view of the sewing machine walking foot.
Figure 10:
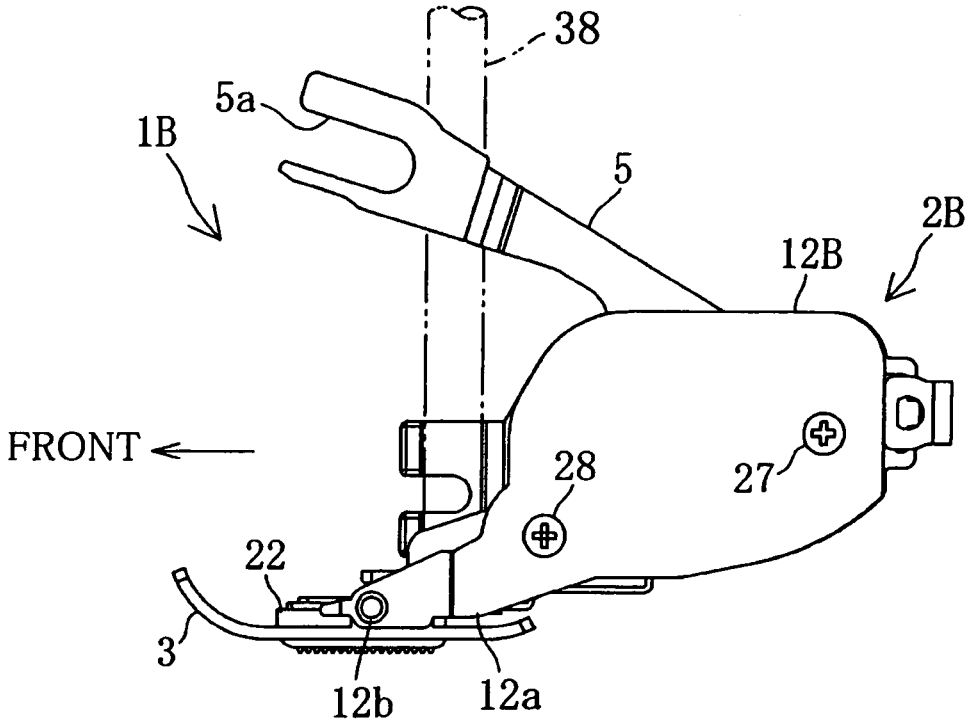
FIG. 10 is a right side view of the sewing machine walking foot.
Figure 11:
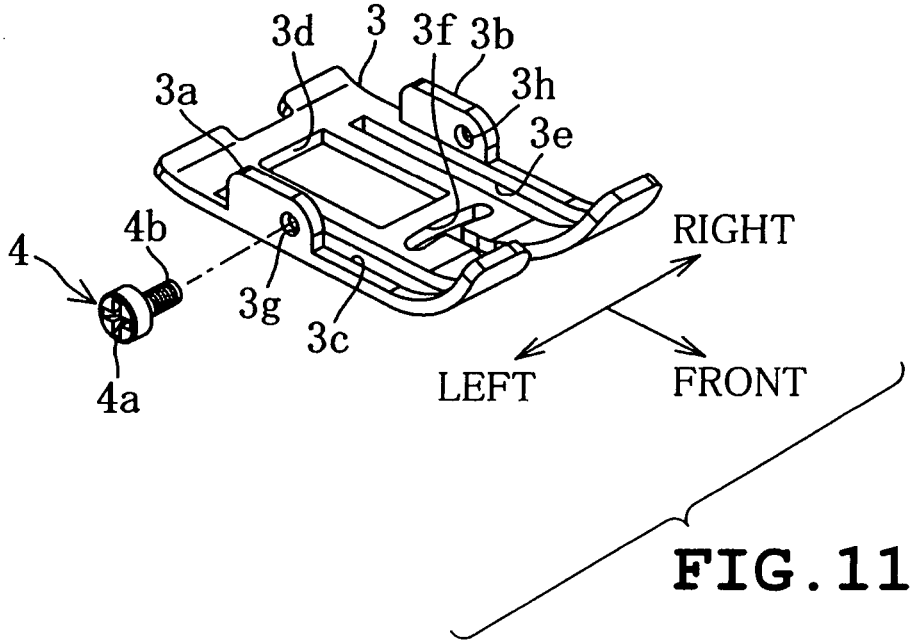
FIG. 11 is a perspective view of the presser foot.
Figure 12:
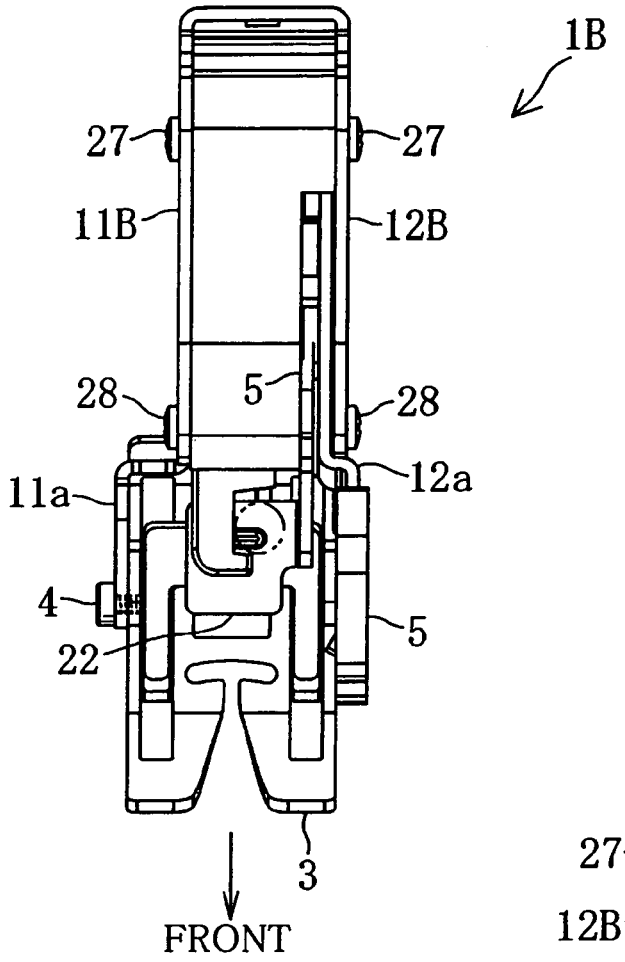
FIG. 12 is a plan view of the sewing machine walking foot.
Figure 13:
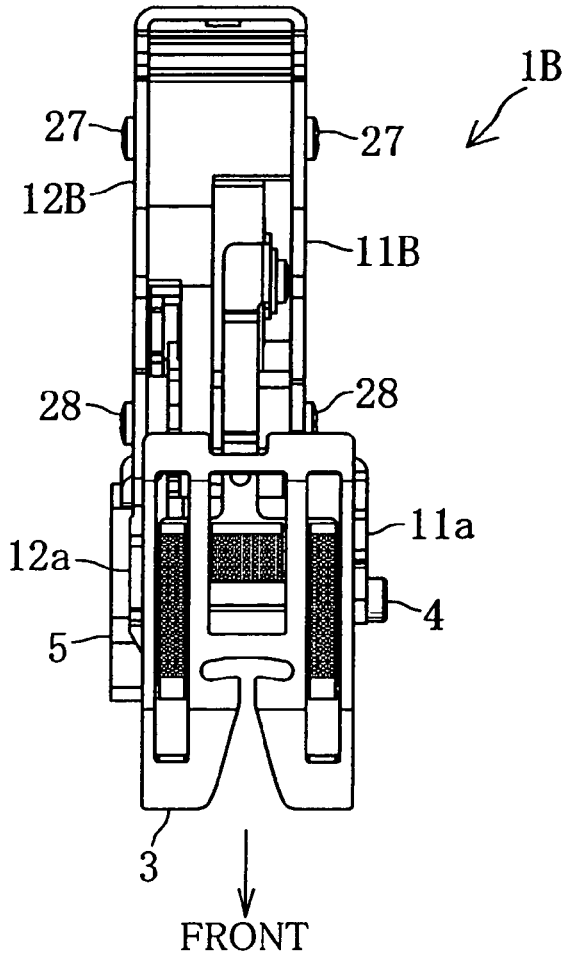
FIG. 13 is a bottom view of the sewing machine walking foot.
Figure 14:
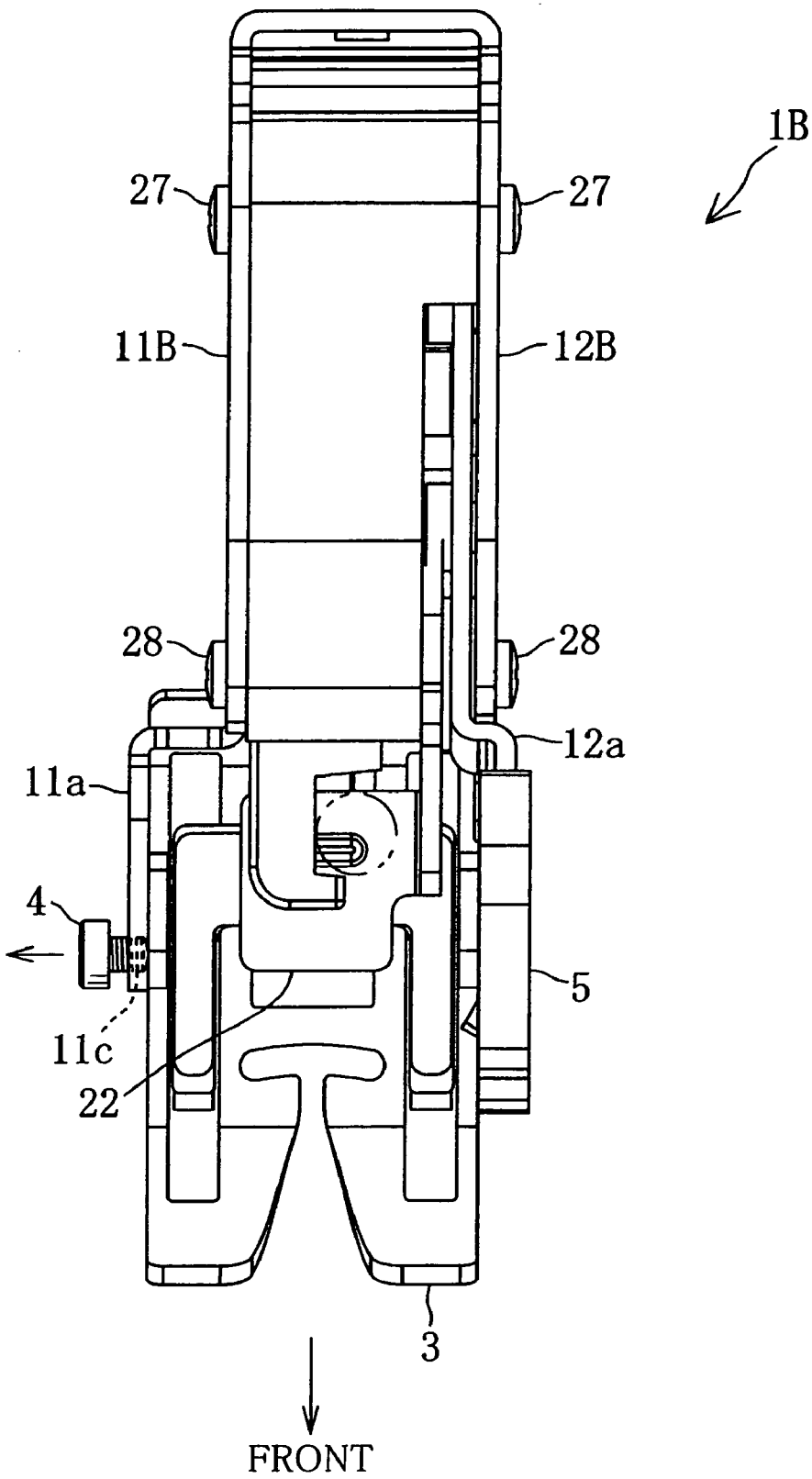
FIG. 14 is a view similar to FIG. 12, showing the case where a presser foot is replaced by another.

The right side plate 12B comprises a single plate-shaped member and fixed at the rear end thereof and the middle thereof in the front-rear direction to the right side of the holder 10 by first and second fixing screws 27 and 28 respectively. The right engagement pin 12*b* is provided on the front end of the right side plate 12B. The right engagement pin 12*b* is fitted in the right engagement arm 12*a* and the right engagement hole 3*h* of the right engaged portion 3*b*. The screw 4 constitutes an engagement pin serving as the engagement support as shown in FIGS. 8, 9 and 12. The screw 4 comprises a head 4*a* and a pin-shaped thread portion 4*b*. More specifically, when the screw 4 is threaded into a screw hole 11*c* of the left engagement arm 11*a*, the pin-shaped thread portion 4*b* is fitted in the left engagement hole 3*g* of the left engaged portion 3*a* of the presser foot 3.

Thus, the screw 4 and the right engagement pin 12*b* are usually engaged with the right and left holes 3*g* and 3*h* formed in the presser foot 3, thereby assuming the engagement positions. The swing supporting mechanism 7B comprises the right and left side plates 11B and 12B, the screw 4 and the right engagement pin 12*b*. Furthermore, the disengaging mechanism 8B is composed of the screw 4 and the like.

The operation of the walking foot will now be described. When replacing the presser foot 3 by another in quilting, the operator loosens the screw 4 using a suitable screwdriver until the pin-shaped thread portion 4*b* departs from the left engagement hole 3*g* of the presser foot 3. As a result, the screw 4 is moved horizontally outward (leftward) thereby to be switched to the disengagement position. In this case, the presser foot 3 can be detached when the screw 4 has departed from the left engagement hole 3*g*. The operator then prepares another presser foot 3 to be used and fits the right engagement pin 12*b* into the right engagement hole 3*h* of the presser foot 3. The operator tightens the screw 4 with the screwdriver when the left engagement hole 3*g* of the presser foot 3 has been positioned so as to correspond to the screw 4. Consequently, the screw 4 is fitted in the left engagement hole 3*g*, whereby replacement of the presser foot 3 is completed.

In the second illustrative example, the walking foot 1B comprises the supporting member 2B provided with the engagement pin 12*b* and the screw 4 fixed to the lower end of the presser bar 38 and supporting the presser foot 3, the swing supporting mechanism 7B engaging the screw 4 and the right engagement pin 12*b* with the paired engagement holes 3*g* and 3*h* provided in the presser foot 3 so that the presser hoot 3 is supported by the supporting member 2B so as to be swingable, and the disengaging mechanism 8B capable of moving the screw 4 horizontally outward from the engagement position where the screw 4 is in engagement with the left engagement hole 3*g* and switching the screw 4 to the disengagement position where the screw 4 is disengaged from the left engagement hole 3*g*. The swing supporting mechanism 7B has at least one screw 4 composing the engagement pin. The disengaging mechanism 8B is constructed so as to be capable of disengaging the screw 4 from the left engagement hole 3*g* when the operator loosens the screw 4 with the screwdriver externally. Consequently, the operator can detach the presser foot 3 easily and quickly from the supporting member 2B when only loosening the screw 4.

In the second illustrative example, the right side plate 12B may also be formed with a screw hole in the front end (distal end) of the right engagement arm 12*a* of the right side plate 12B. A screw composing the engagement pin may be screwed with the screwdriver in the same manner as the left side plate 11B.

A third illustrative example of the disclosure will be described with reference to FIGS. 15 to 20. A walking foot 1C basically has the same construction as the walking foot 1A of the first illustrative example. Identical or similar parts in the second illustrative example are labeled by the same reference symbols as those in the first illustrative example. The walking foot 1C comprises the supporting member 2C serving as the body, presser foot 3, swing lever 5, cloth feeding mechanism 6, swing supporting mechanism 7C, disengaging mechanism 8C or the like. The supporting member 2C comprises a holder 10, a pair of right and left side plates 11C and 12C provided on right and left sides of the holder 10 respectively, and a lever 14.

The left side plate 11C comprises a single plate-shaped member and fixed at the rear end thereof and the middle thereof in the front-rear direction to the right side of the holder 10 by first and second fixing screws 27 and 28 respectively. The left side plate 11C has a left engagement arm 11*a* formed integrally in the front end thereof. The left engagement arm 11*a* has a supporting hole 11*c* formed in a front end (distal end) thereof. The lever 14 is made of a leaf spring and formed substantially into the shape of a crank as viewed on a plane as shown in FIGS. 15, 16, 18 and 19. More specifically, the lever 14 has a front end having a left engagement arm 14*a* formed integrally therewith. The left engagement arm 14*a* has a front end (distal end) formed with a left engagement pin 14*b* protruding rightward and serving as an engagement support portion. The lever 14 further has a fulcrum 14*c* formed at a lengthwise middle thereof and a rear end (proximal end) formed with an operating portion 14*d*. The lever 14 is fixed at the fulcrum 14*c* to a left end of a support shaft 18 by the second fixing screw 28. The support shaft 18 extends through the holder 10 in the right-left direction. Accordingly, the lever 14 is supported in a stable position, and the left engagement pin 14*b* of the lever 14 is usually located at an engagement position where the left engagement pin 14*b* is in engagement with the left engagement hole 3*g* through a support hole lie of the left engagement arm 11*a*.

Figure 15:
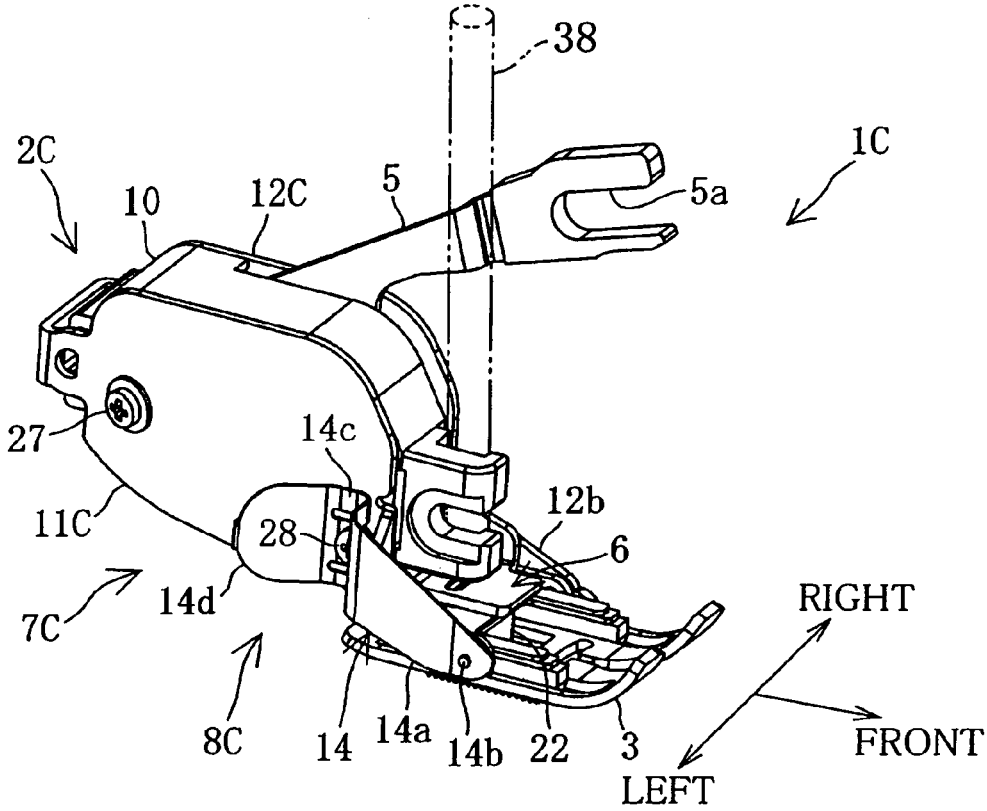
FIG. 15 is a perspective view of the sewing machine walking foot of a third illustrative example in accordance with the disclosure.
Figure 16:
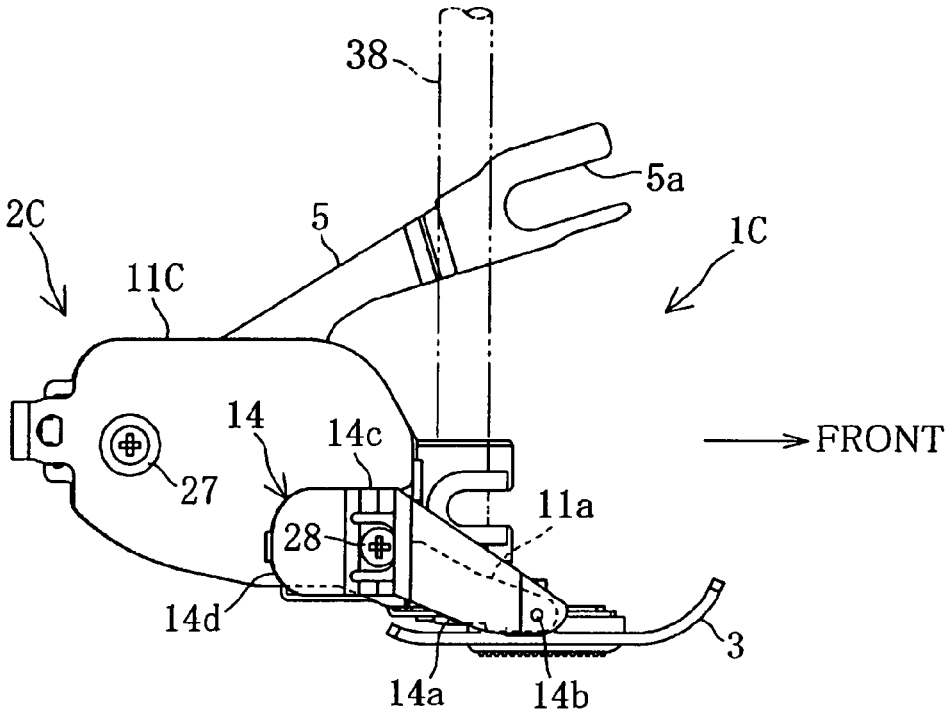
FIG. 16 is a left side view of the sewing machine walking foot.
Figure 17:
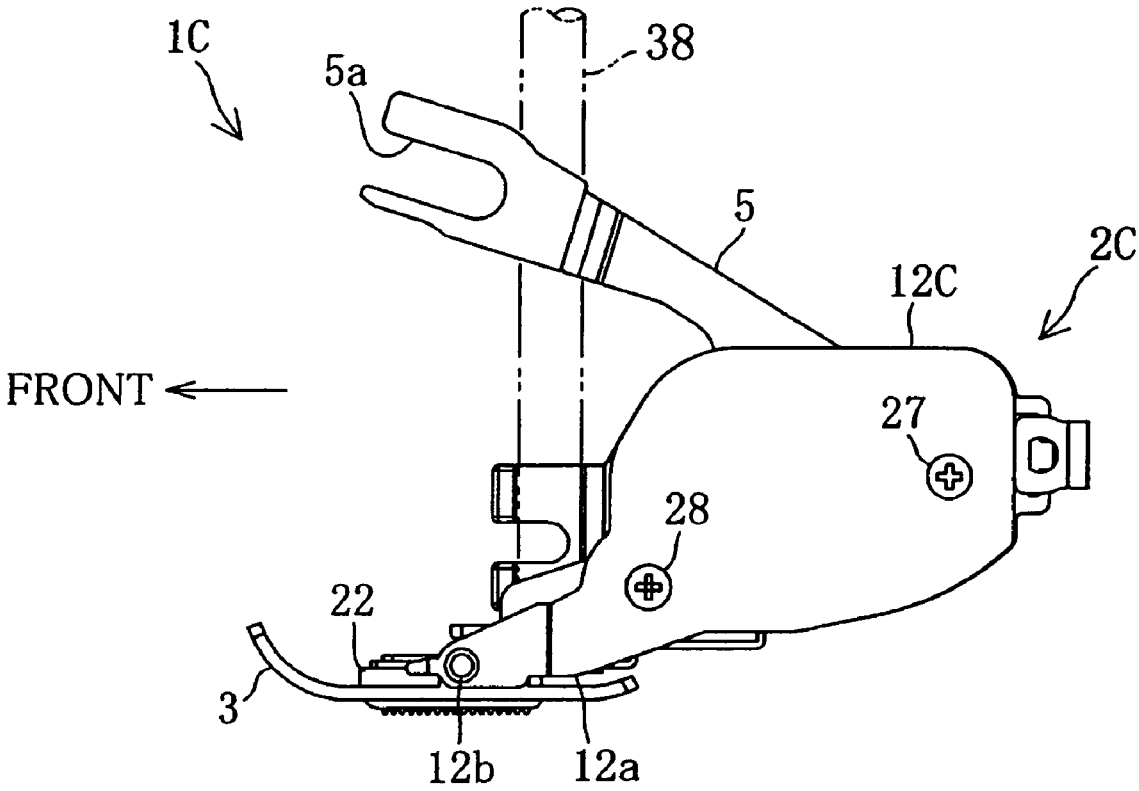
FIG. 17 is a right side view of the sewing machine walking foot.
Figure 18:
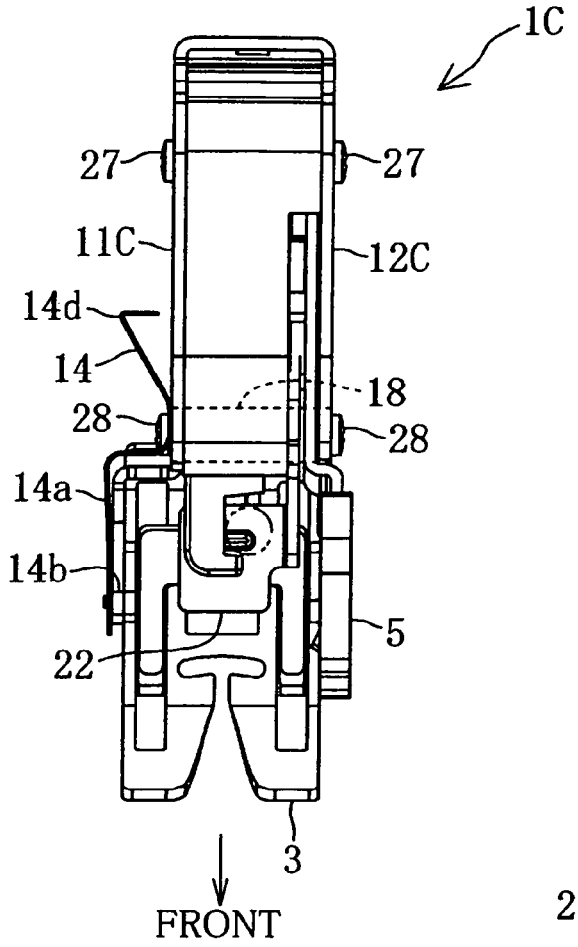
FIG. 18 is a plan view of the sewing machine walking foot.
Figure 19:
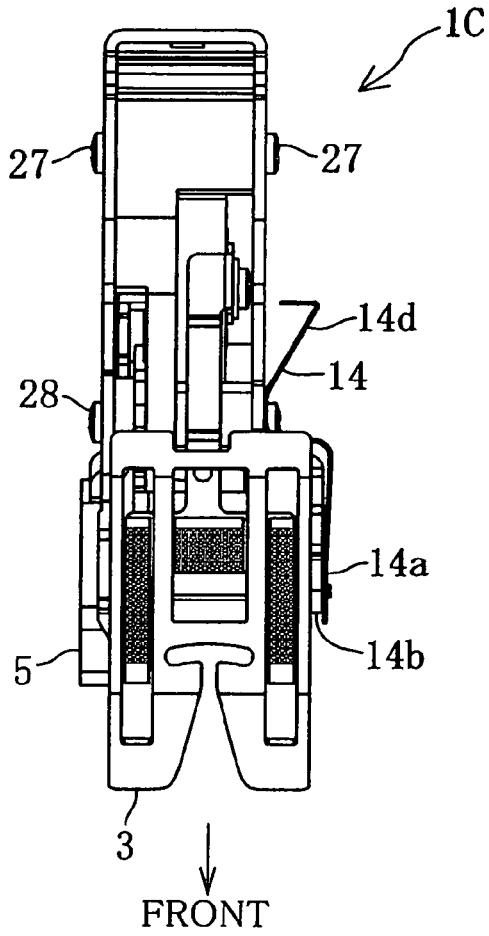
FIG. 19 is a bottom view of the sewing machine walking foot.

A right side plate 12C comprises a single plate member and includes a rear end as shown in FIGS. 15 and 17. The right side plate 12C is detachably attached at the rear end thereof and the middle thereof in the front-rear direction to a right side of the holder 10 by the first and second fixing screws 27 and 28. The right side plate 12C has a front end on which a right engagement arm 12*a* is formed integrally. The right engagement arm 12*a* is provided with a right engagement pin 12*b* which is to be engaged with the right engagement hole 3*h* of the presser foot 3. Thus, the engagement pins 14*b* and 12*b* are usually in engagement with the engagement holes 3*g* and 3*h* formed in the presser foot 3, thereby assuming engagement positions, respectively. A swing supporting mechanism 7 is composed of the lever 14, paired right and left side plates 11C and 12C and the like. A disengaging mechanism 8C is composed of the lever 14 and the like.

Figure 20:
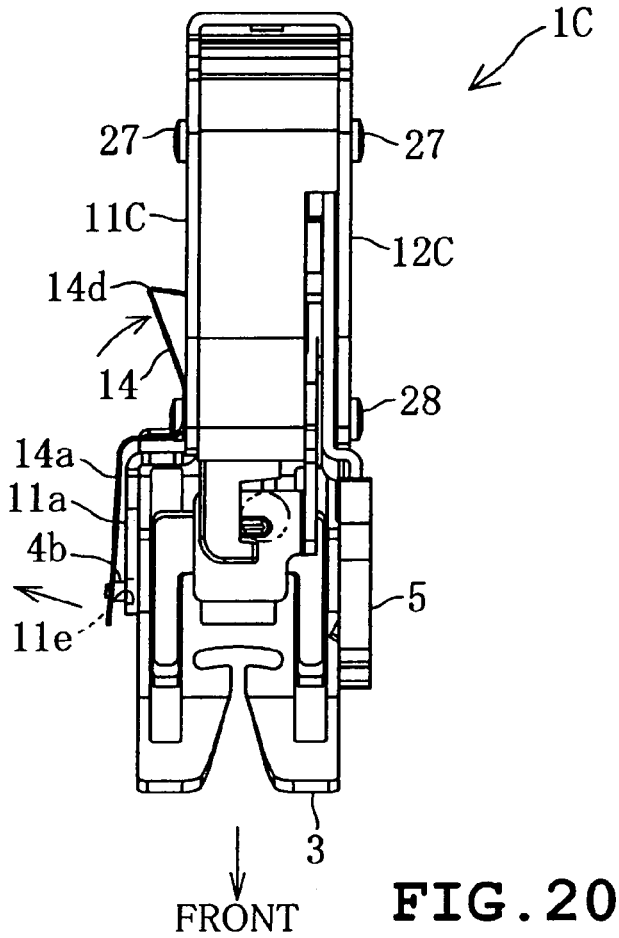
FIG. 20 is a view similar to a view similar to FIG. 18, showing the case where a presser foot is replaced by another.

The following describes the operation of the walking foot 1C constructed as described above. As shown in FIG. 20, when replacing the presser foot 3 by another in quilting, the operator firstly presses the operating portion 14*d* of the lever 14 to the left side plate 11C side (clockwise as viewed in FIG. 20). As a result, since the lever 14 pivots about the fulcrum 14*c* clockwise, the left engagement pin 14*b* provided on the distal end of the left engagement arm 14*a* is moved horizontally outward thereby to be switched to a disengagement position. In this case, the left engagement pin 14*b* is disengaged from the left engagement hole 3*g* such that the presser foot 3 can be detached. The operator then prepares another presser foot 3 and fits the right engagement pin 12*b* in the right engagement hole 3*h* while depressing the operating portion 14*d*. The operating portion 14*d* is released from depression under the condition where the left engagement hole 3*g* of the presser foot 3 is positioned so as to correspond to the left engagement pin 14*b*. As a result, the left engagement pin 14*b* is fitted in the left engagement hole 3*g*, whereby the replacement of the presser foot 3 is completed.

As obvious from the foregoing, the supporting member 2C includes the lever 14 having the fulcrum 14*c* formed at the lengthwise middle thereof and the operating portion 14*d* provided on the proximal end thereof and the left side plate 11C supporting the fulcrum 14*c* and having the support hole 11*e* with and into which the left engagement pin 14*b* is engageable and insertable. The disengaging mechanism 8C is constructed so that when the operating portion 14*d* is pressed to the left side plate 11C side, the left engagement pin 14*b* is switched via the fulcrum 14*c* from the engagement position to the disengagement position. Consequently, the operator can detach the presser foot 3 easily and quickly from the supporting member 2C with interposition of the disengaging mechanism 8C when only pressing the operating portion 14*d* of the lever 14 to the left side plate 11C side.

Modified forms of the third illustrative example will now be described. In the third illustrative example, the right side plate 12C may also be formed with a lever having a right engagement pin in the same manner as the left side plate 11C. In this case, the operator simultaneously presses the right and left levers when the presser foot 3 is to be replaced by another. Furthermore, the left lever 14 may be eliminated and thus, only the right lever may be provided.

A fourth illustrative example of the disclosure will now be described with reference to FIGS. 21 to 27. A walking foot 1D basically has the same construction as the walking foot 1A of the first illustrative example. Identical or similar parts in the second illustrative example are labeled by the same reference symbols as those in the first illustrative example. The walking foot 1D comprises the supporting member 2D serving as the body, presser foot 3, swing lever 5, cloth feed mechanism 6, swing supporting mechanism 7D, disengaging mechanism 8D or the like.

The supporting member 2D comprises the holder 10, a pair of right and left side plates 11D and 12D mounted on right and left sides of the holder 10 respectively and a left pivoting member. The left side plate 11D is sized so as to cover almost an entire left side of the holder 10 and is detachably fixed to the left side of the holder 10 by the first fixing screw 27.

Figure 21:
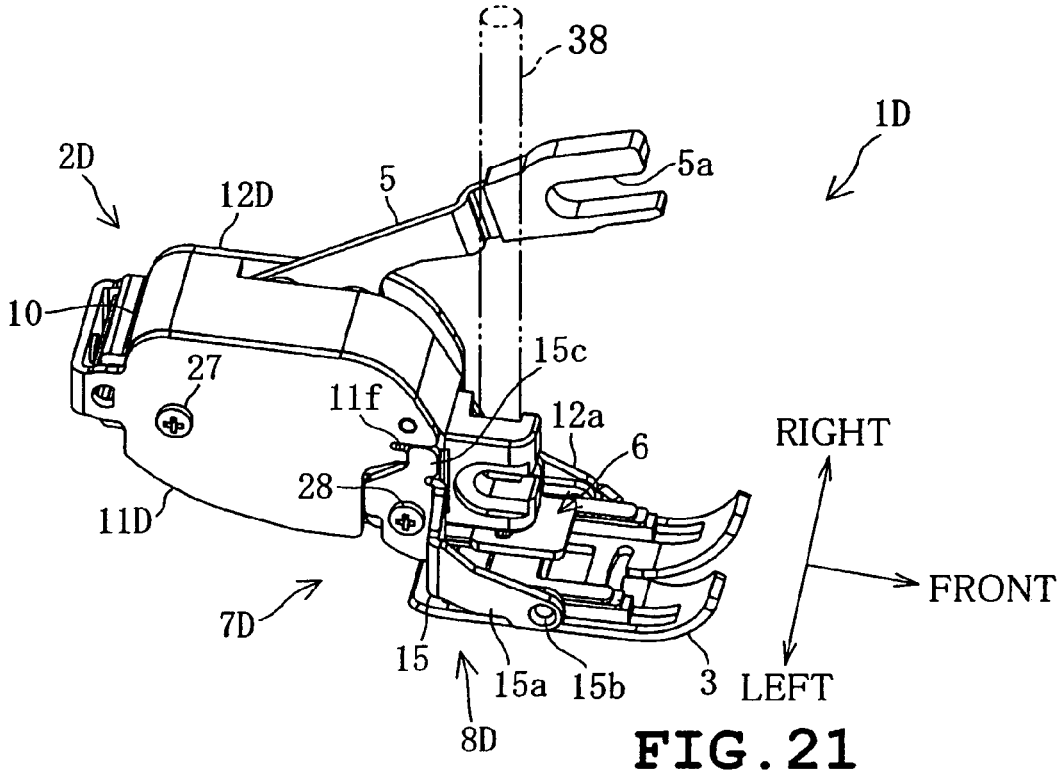
FIG. 21 is a perspective view of the sewing machine walking foot of a fourth illustrative example in accordance with the disclosure.
Figure 22:
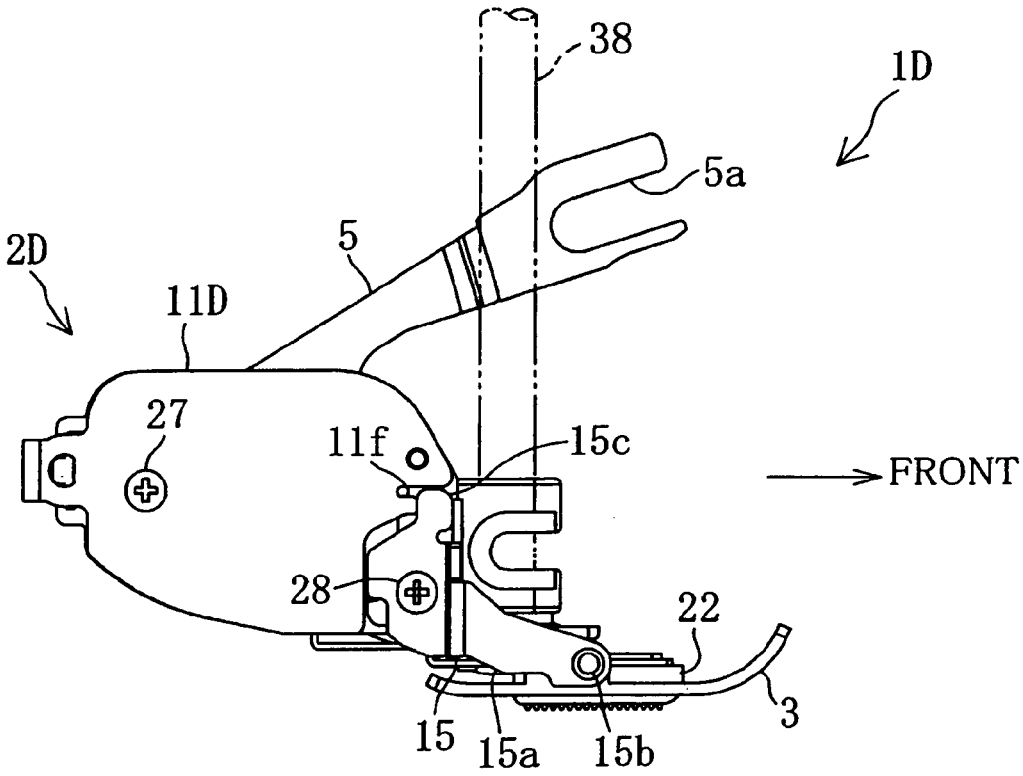
FIG. 22 is a left side view of the sewing machine walking foot.
Figure 26:
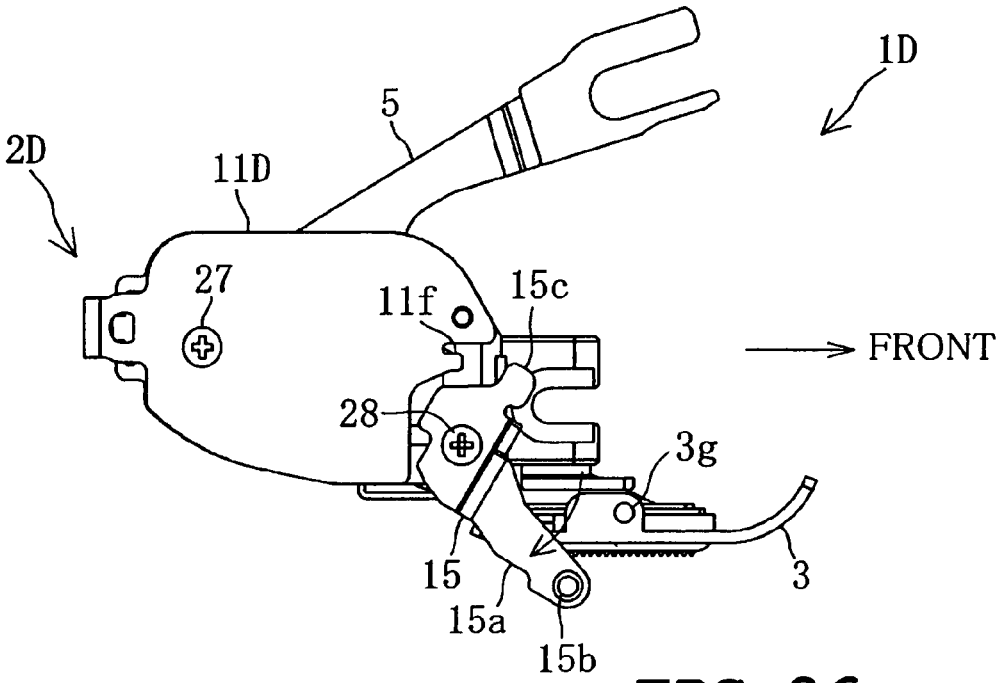
FIG. 26 is a view similar to a view similar to FIG. 22, showing the case where a presser foot is replaced by another.

A left pivoting member 15 is formed substantially into the shape of a crank as viewed on a plane as shown in FIGS. 21, 22 and 26. The left pivoting member 15 has a rear end which is detachably fixed to the left side of the holder 10 by the second fixing screw 28 so as to be switchable between an engagement position as shown in FIG. 22 and a disengagement position as shown in FIG. 26. A left engagement arm 15*a* is formed integrally on the front end of the left pivoting member 15. The left engagement arm 15*a* has a front or distal end from which a left engagement pin 15*b* serving as an engagement protrudes rightward. When the left pivoting member 15 is in the engagement position, the left engagement pin 15*b* assumes the engagement position where the left engagement pin 15*b* engages the left engagement hole 3*g* of the presser foot 3. When the left pivoting member 15 is in the disengagement position, the left engagement pin 15*b* assumes the disengagement position where the left engagement pin 15*b* is disengaged from the left engagement hole 3*g* of the presser foot 3.

Furthermore, the left side plate 11D has a front end from which a left locking portion 11*f* protrudes. The left pivoting member 15 has an upper end formed with a left abutment 15*c*. More specifically, as shown in FIG. 22, when the left pivoting member 15 is switched to the engagement position, the left abutment 15*c* thereof abuts the left locking portion 11*f* of the left side plate 11D, where by the left pivoting member 15 is prevented from further counterclockwise pivot. As a result, the left pivoting member 15 is reliably held in the engagement position.

Figure 23:
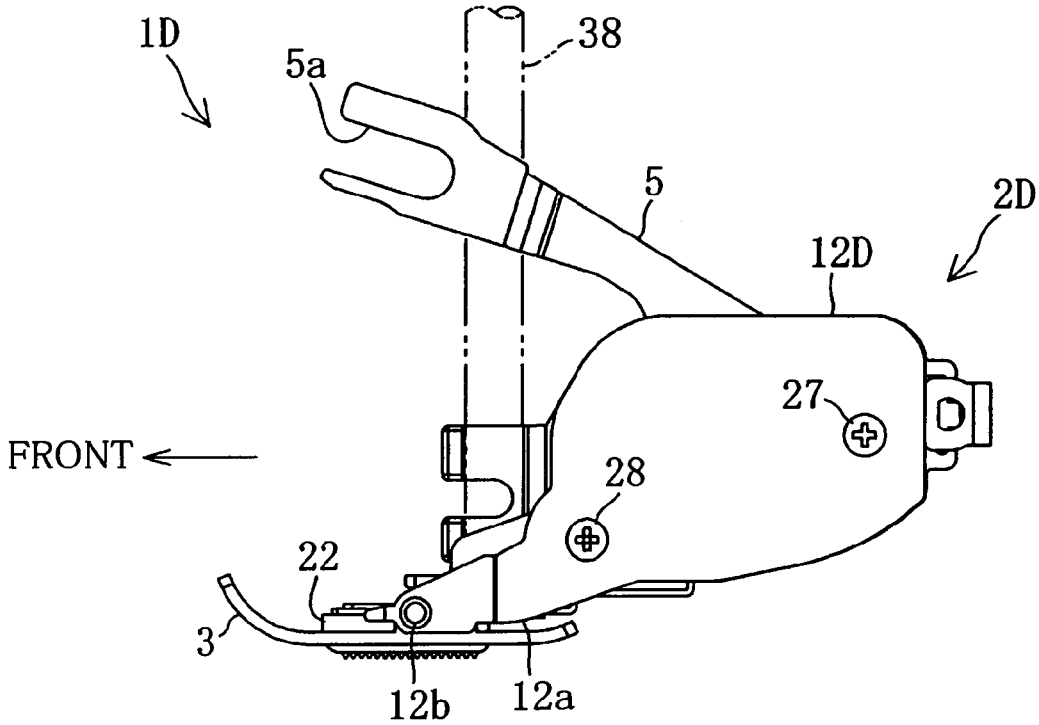
FIG. 23 is a right side view of the sewing machine walking foot.
Figure 24:
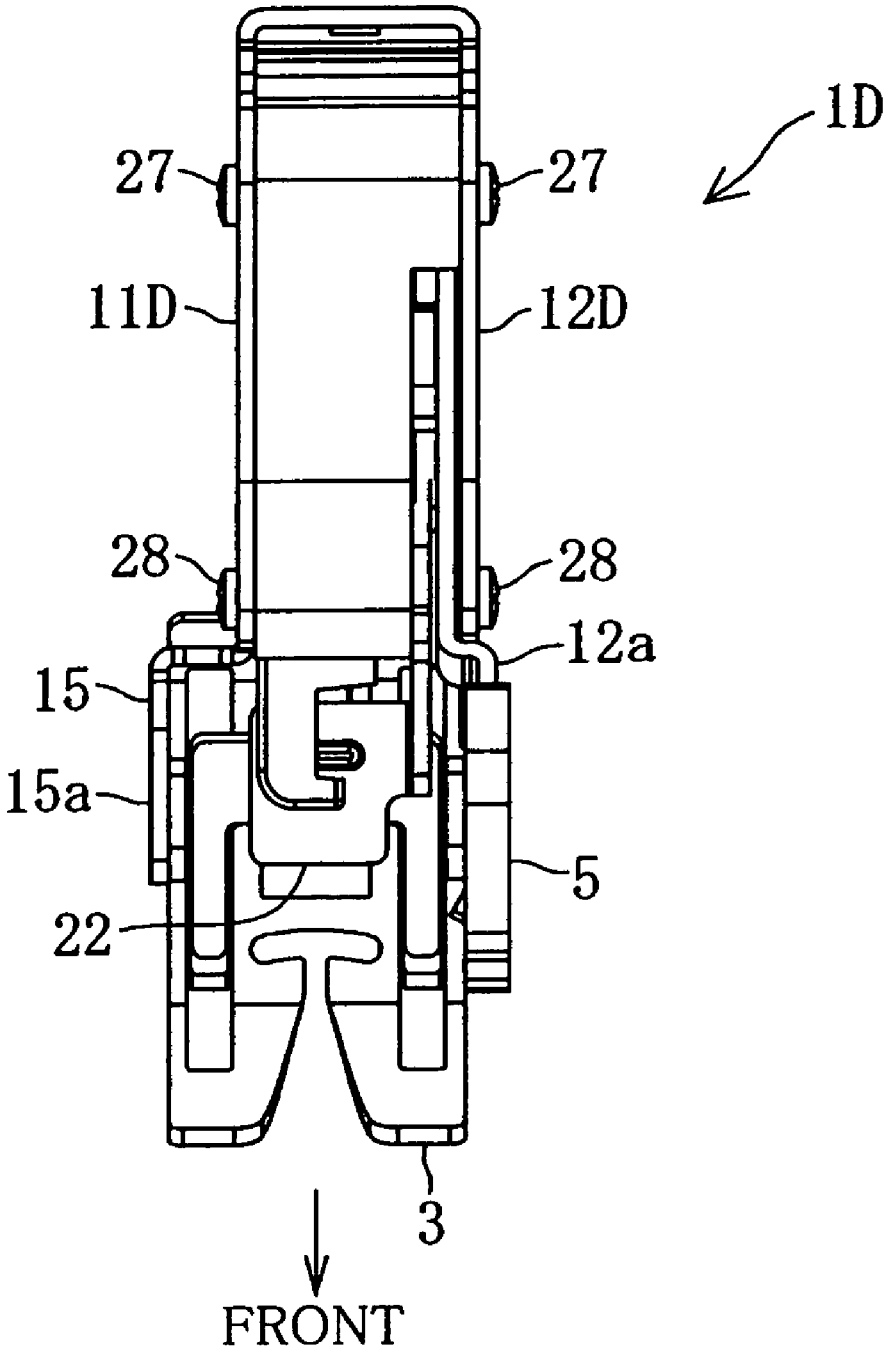
FIG. 24 is a plan view of the sewing machine walking foot.
Figure 25:
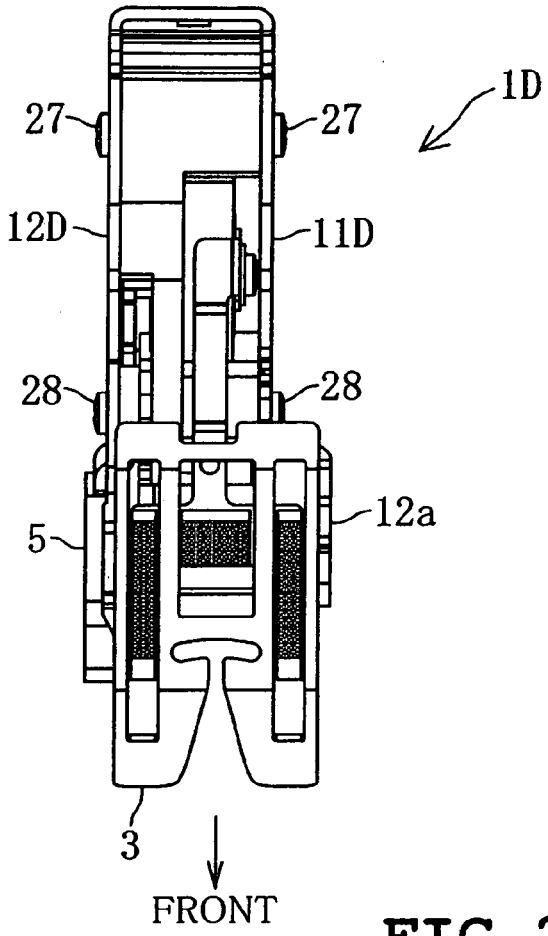
FIG. 25 is a bottom view of the sewing machine walking foot.

The right side plate 12B comprises a single plate-shaped member and detachably fixed at the rear end and the middle in the front-rear direction to the right side of the holder 10 by first and second fixing screws 27 and 28 respectively as shown in FIGS. 21 and 23. The right side plate 12D has a front end on which the right engagement arm 12*a* is formed integrally therewith. The right engagement pin 12*a* has a front end (distal end) provided with the right engagement pin 12*b* which is to engage the right engagement hole 3*h* of the presser foot 3. The swing supporting mechanism 7D comprises the left pivoting member 15, right side plate 12D and the paired engagement pins 15*b* and 12*b*. Furthermore, the disengaging mechanism 8D comprises the left pivoting member 15.

Figure 27:
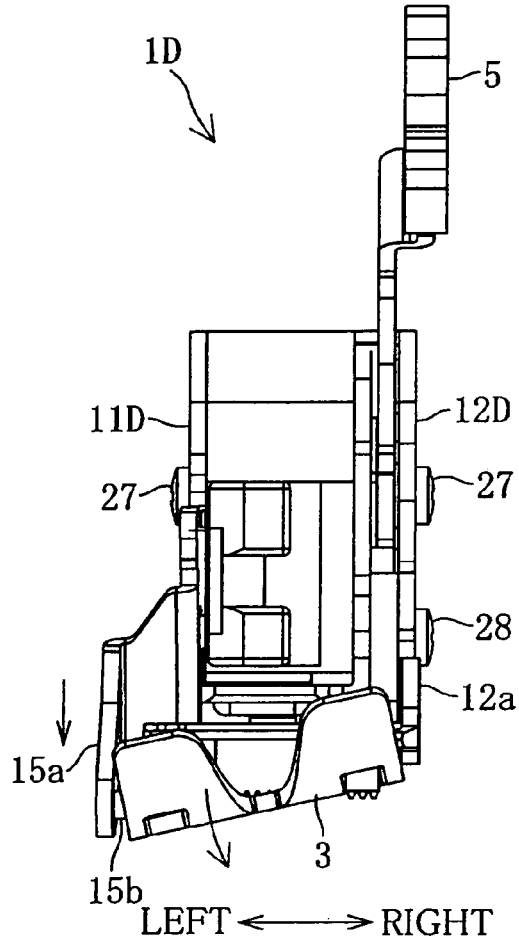
FIG. 27 is a front view of the sewing machine walking foot in the case where the presser foot is replaced by another.

The following describes the operation of the walking foot 1D constructed as described above. As shown in FIGS. 26 and 27, when replacing the presser foot 3 by another in quilting, the operator firstly causes the left pivoting member 15 to pivot clockwise as viewed in FIG. 26. In this case, the presser foot 3 is inclined counterclockwise as viewed at the front simultaneously with downward movement of the left engagement pin 15*b* as shown in FIG. 27. Consequently, the distance between the right and left engagement pins 12*b* and 15*b* is increased, whereupon the left engagement pin 15*b* is disengaged from the left engagement hole 3*g*. Accordingly, the presser foot 3 can be detached. The operator then prepares another presser foot 3*g* to be replaced by the detached one. The operator firstly fits the right engagement pin 12*b* into the right engagement hole 3*h* of the presser foot 3. The operator then causes the left pivoting member 15 to pivot to the original engagement position while causing the left engagement hole 3*g* of the presser foot 3 to correspond to the left engagement pin 15*b*. As a result, the left engagement pin 15*b* is fitted in the left engagement hole 3*g*, whereby the replacement of the presser foot 3 is completed.

As obvious from the foregoing, the supporting member 2D includes the left pivoting member 15 having the left engagement pin 15*b* on the distal end and the left side plate 11D on which the left pivoting member 15 is pivotally mounted. The disengaging mechanism 8D is constructed so that the left pivoting member 15 is caused to pivot so that the left engagement pin 15*b* is switched from the engagement position to the disengagement position. Consequently, the operator can detach the presser foot 3 easily and quickly from the supporting member 2D with interposition of the disengaging mechanism 8D when only causing the left pivoting member 15 to pivot.

A fifth illustrative example of the disclosure will now be described with reference to FIGS. 28 to 39. A walking foot 1E basically has the same construction as the walking foot 1D of the fourth illustrative example. Identical or similar parts in the second illustrative example are labeled by the same reference symbols as those in the fourth illustrative example. The walking foot 1E comprises the supporting member 2E serving as the body, presser foot 3, swing lever 5, cloth feeding mechanism 6, swing supporting mechanism 7E, disengaging mechanism 8E.

Figure 28:
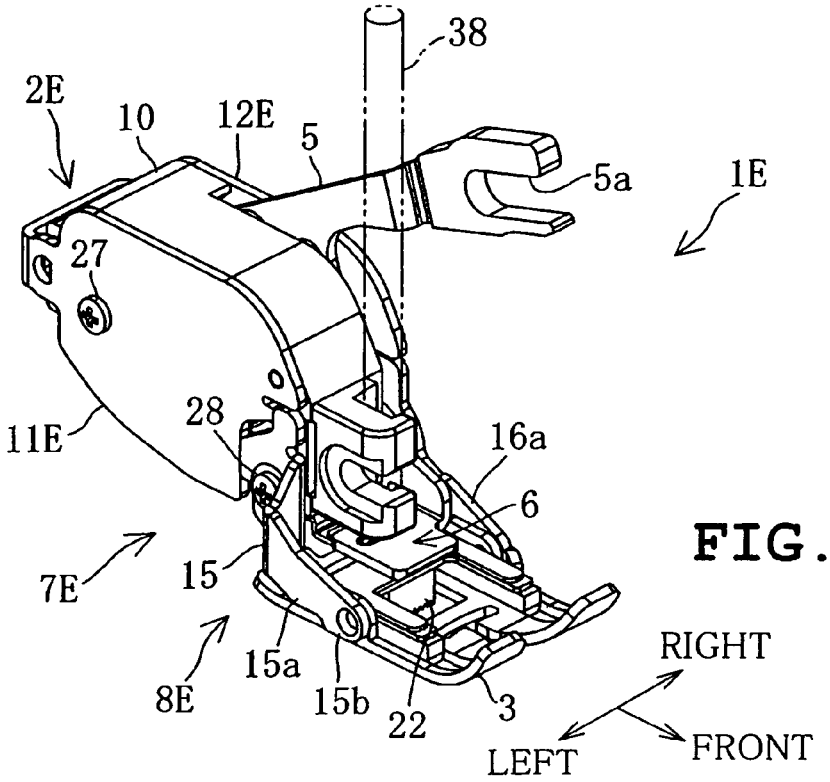
FIG. 28 is a is a perspective view of the sewing machine walking foot of a fifth illustrative example in accordance with the disclosure.
Figure 29:
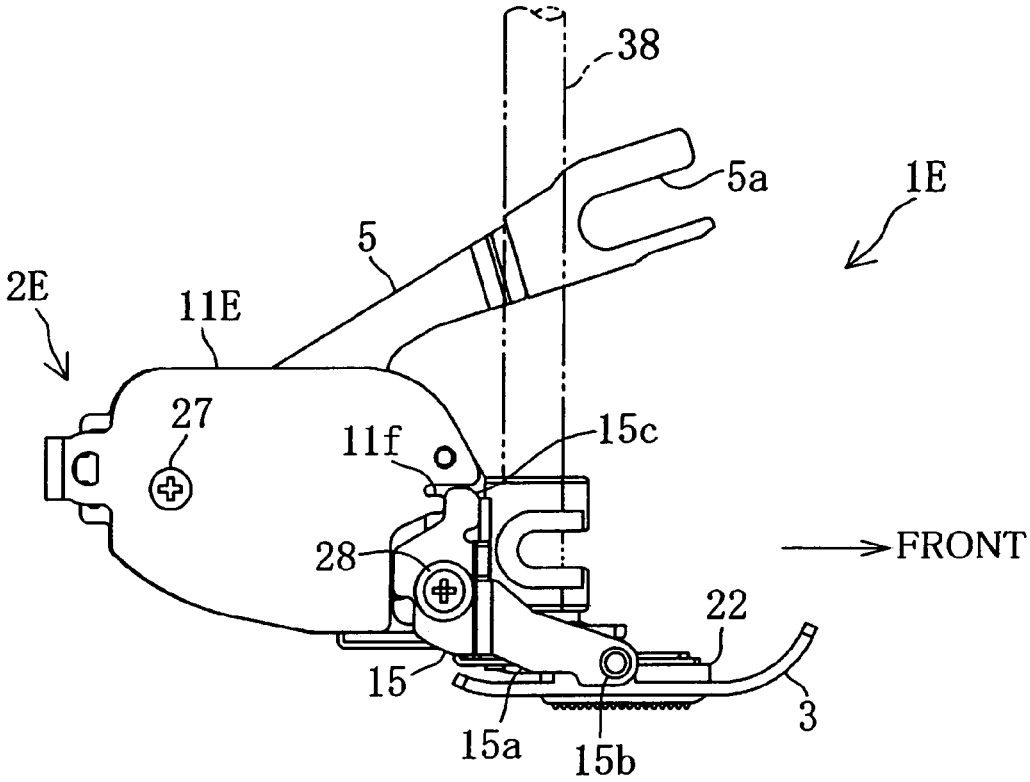
FIG. 29 is a left side view of the sewing machine walking foot.
Figure 35:
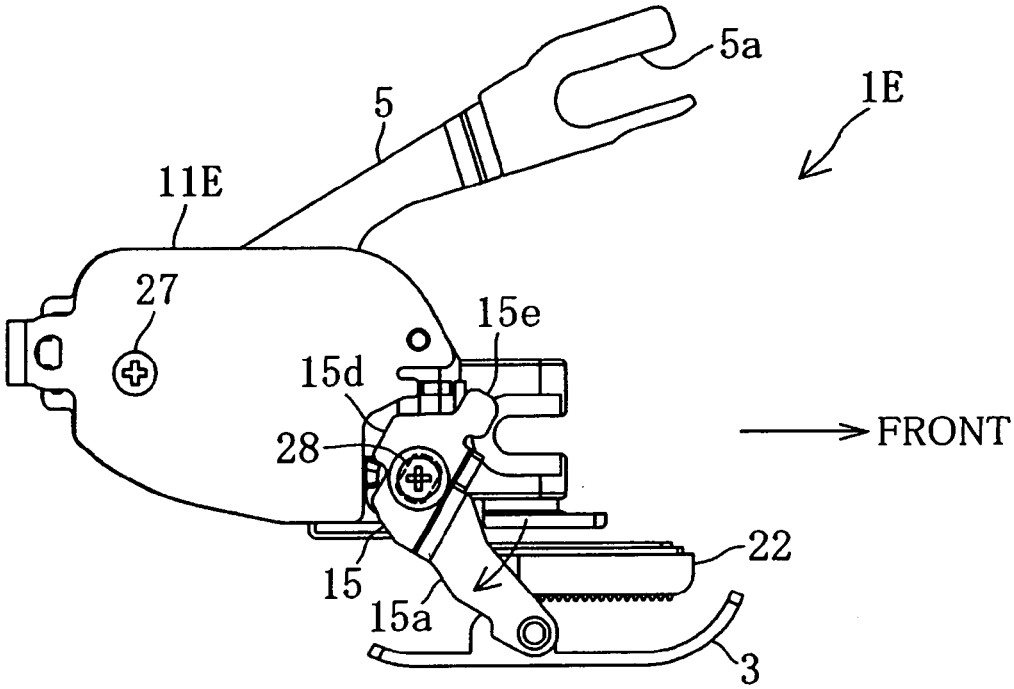
FIG. 35 is a view similar to FIG. 29, showing the case where the presser foot is replaced by another.
Figure 39:
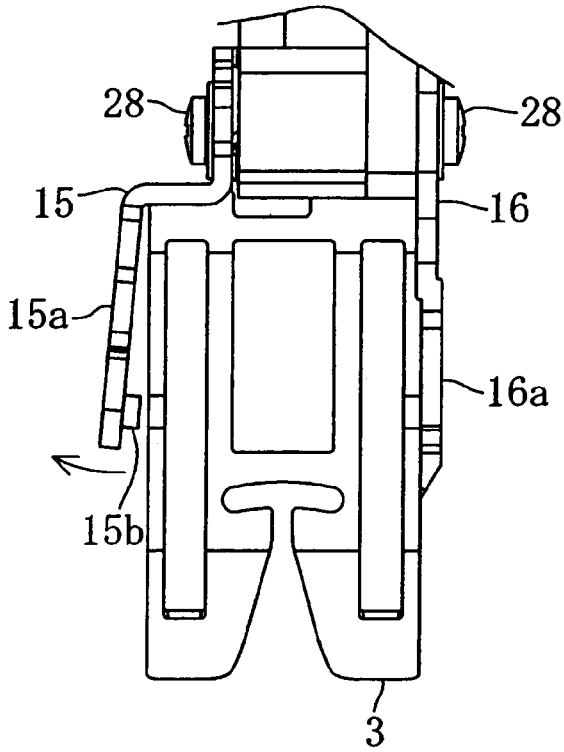
FIG. 39 is a partially enlarged view of FIG. 31 in the case where the presser foot is replaced by another.

The supporting member 2E comprises the holder 10, a pair of right and left side plates 11E and 12E provided on right and left sides of the holder 10, a pair of right and left pivoting members 15 and 16 and a cam mechanism 17. The left side plate 11E is sized so as to cover almost an entire left side of the holder 10 and is detachably fixed to the holder 10 by the first fixing screw 27 as shown in FIGS. 28 and 29. The left pivoting member 15 is formed substantially into the shape of a crank as viewed on a plane as shown in FIGS. 28, 29 and 39. The left pivoting member 15 is supported at its rear end on the holder 10 by the second fixing screw 28 so as to be switchable between the engagement position as shown in FIG. 28 and the disengagement position as shown in FIG. 35.

The left pivoting member 15 has a front end with which a left engagement arm 15*a* is integrally formed in the same manner as described above. The left engagement arm 15*a* further has a front or distal end provided with a left engagement pin 15*b*. When the left pivoting member 15 is in the engagement position as shown in FIG. 29, the left engagement pin 15*b* assumes the engagement position where the left engagement pin 15*b* engages the left engagement hole 3*g* of the presser foot 3. When the left pivoting member 15 is in the disengagement position, the left engagement pin 15*b* assumes the disengagement position where the left engagement pin 15*b* is disengaged from the left engagement hole 3*g* of the presser foot 3.

The left side plate 11E has a front end from which a left locking portion 11*f* protrudes. The left pivoting member 15 has an upper end formed with a left abutment 15*c*. More specifically, as shown in FIG. 29, when the left pivoting member 15 is switched to the engagement position, the left abutment 15*c* thereof abuts the left locking portion 11*f* of the left side plate 11D, whereby the left pivoting member 15 is prevented from further counterclockwise pivot. As a result, the left pivoting member 15 is reliably held in the engagement position.

Figure 30:
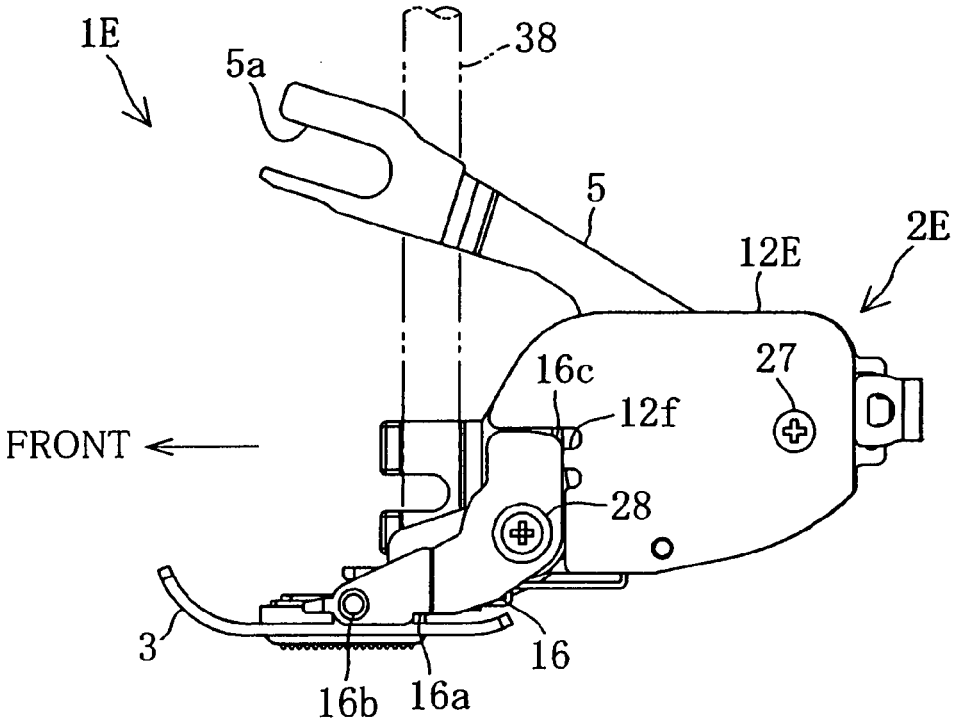
FIG. 30 is a right side view of the sewing machine walking foot.
Figure 36:
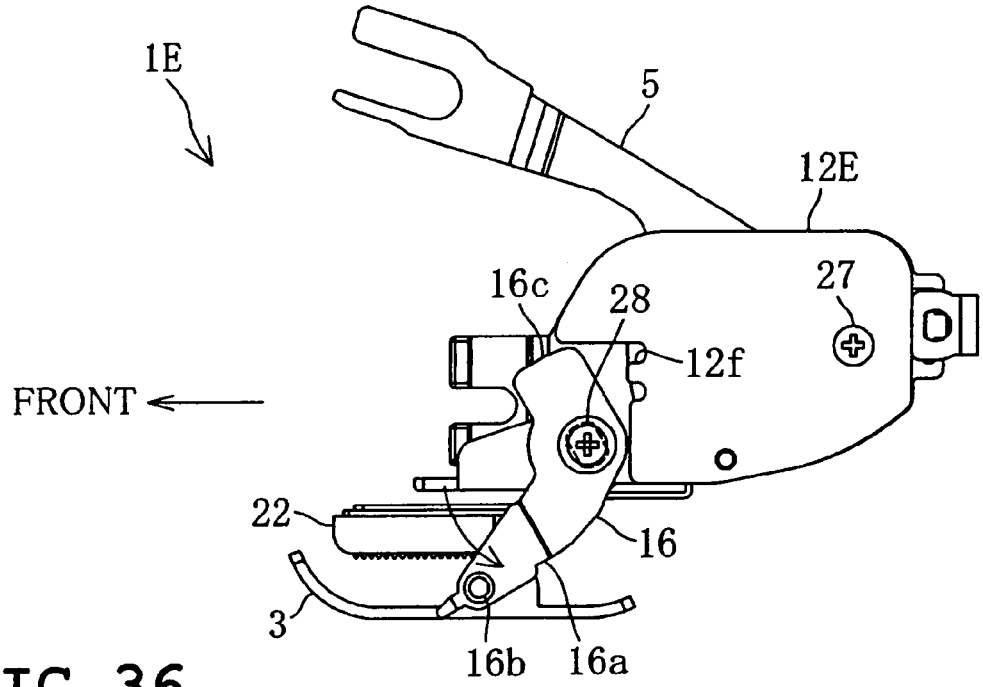
FIG. 36 is a view similar to FIG. 30, showing the case where the presser foot is replaced by another.

The right side plate 12E is sized so as to cover almost an overall right side of the holder 10 and detachably fixed to the right side of the holder 10 by the first fixing screw 27. The right pivoting member 16 is formed substantially into the shape of a crank as viewed on a plane as shown in FIGS. 28, 30 and 36. The right pivoting member 16 is mounted at a front end thereof on the right side of the holder 10 by the second fixing screw 28 so as to be switchable between the engagement position as shown in FIG. 30 and the disengagement position as shown in FIG. 36. The right pivoting member 16 has a front end with which a right engagement arm 16*a* is integrally formed in the same manner as described above. The right engagement arm 16*a* further has a front or distal end provided with a right engagement pin 16*b* protruding leftward. When the right pivoting member 16 is in the engagement position as shown in FIG. 30, the right engagement pin 16*b* assumes the engagement position where the right engagement pin 16*b* engages the right engagement hole 3*h* of the presser foot 3. When the right pivoting member 16 is in the disengagement position as shown in FIG. 36, the right engagement pin 16*b* assumes the disengagement position where the right engagement pin 16*b* is disengaged from the right engagement hole 3*h* of the presser foot 3.

The right side plate 12E has a front end from which a right locking portion 12*f* protrudes. The right pivoting member 16 has an upper end formed with a right abutment 16*c*. More specifically, as shown in FIG. 30, when the right pivoting member 16 is switched to the engagement position, the right abutment 16*c* thereof abuts the right locking portion 12*f* of the left side plate 12E, whereby the right pivoting member 16 is prevented from further clockwise pivot. As a result, the right pivoting member 16 is reliably held in the engagement position.

Figure 34:
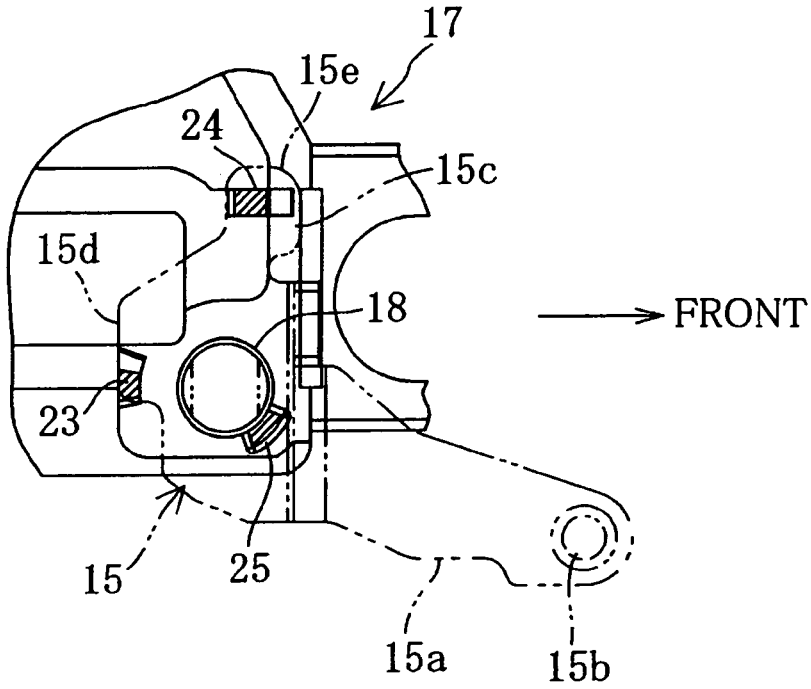
FIG. 34 is an explanatory diagram explaining a left cam mechanism.

A cam mechanism 17 has a single support cam (cam portion) 25 and two or first and second switching cams (cam portions) 23 and 24 which are formed on the left side near to the front end of the holder 10 so as to protrude leftward, as shown in FIGS. 33 and 34. The cam mechanism 17 further has first and second abutment walls 15*d* and 15*e* formed on the left pivoting member 15. The first and second switching cams 23 and 24 and support cam 25 are disposed substantially annularly about a support shaft 18. These switching cams 23 and 24 and support cam 25 have the same leftward-protruding dimension (on the same vertical plane). The lower, first switching cam 23 has an inclined cam continuous to the upper side. Furthermore, the upper, second switching cam 24 also has an inclined cam continuous to the right side (front).

Figure 31:
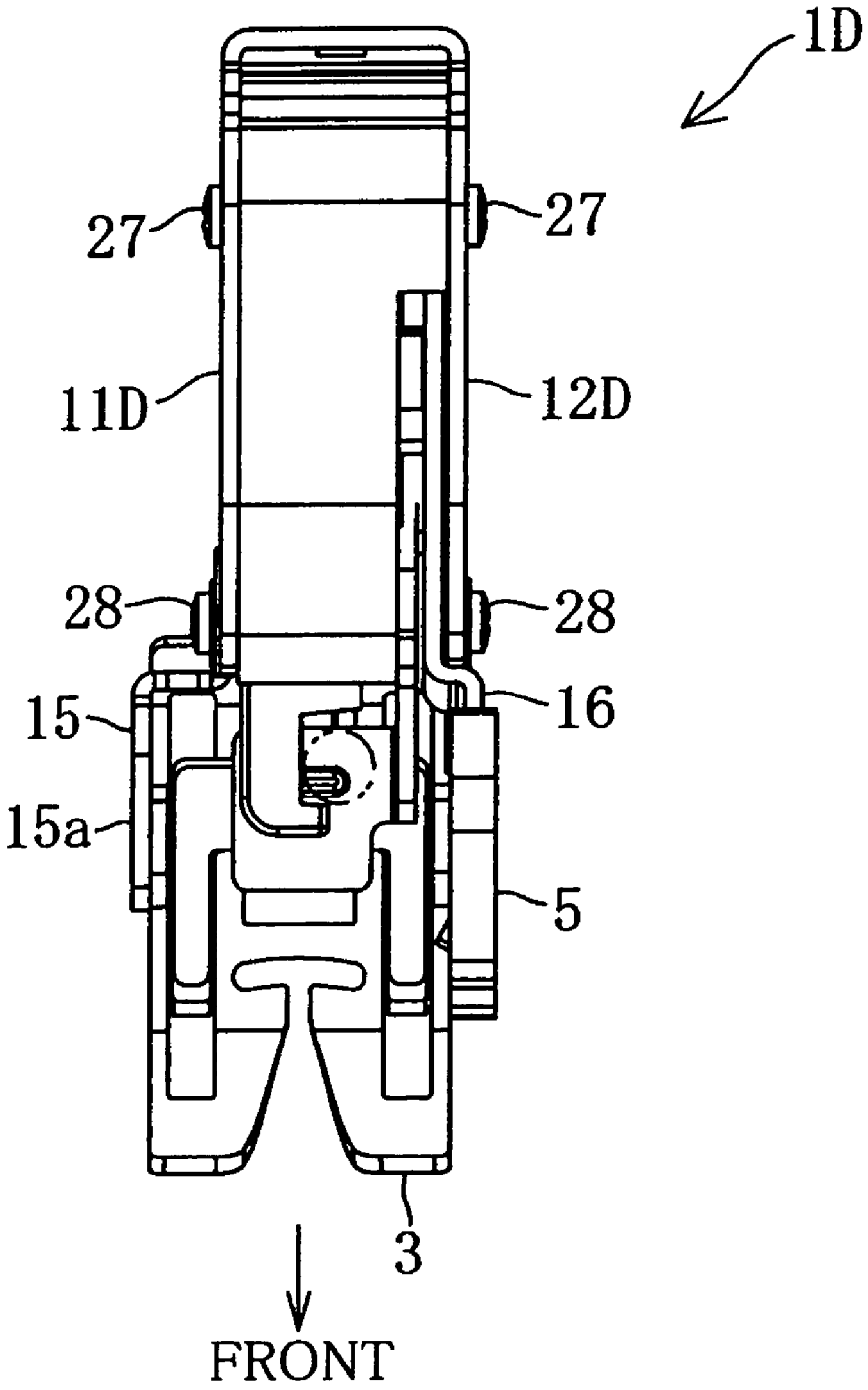
FIG. 31 is a plan view of the sewing machine walking foot.
Figure 38:
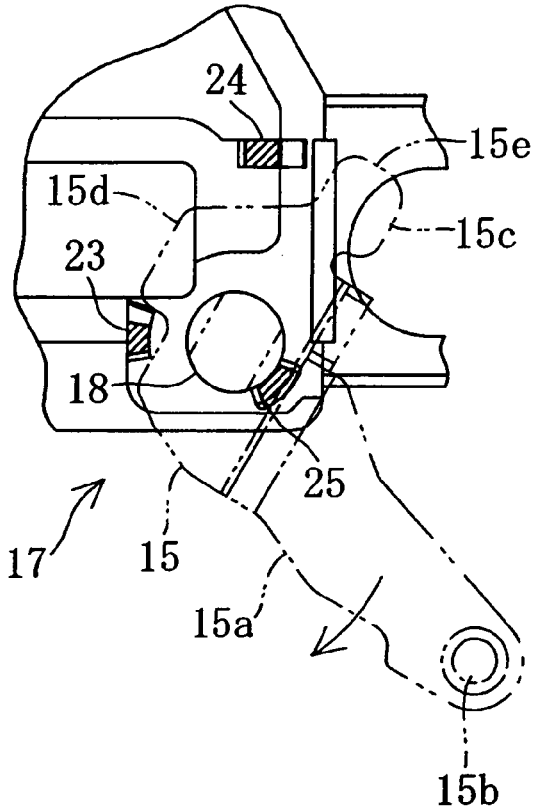
FIG. 38 is an explanatory diagram explaining the left cam mechanism in the case where the presser foot is replaced by another.

The support cam 25 is formed on the front end and a corner of the lower end of the holder 10 and generally has the shape of block. As shown in FIG. 34, the rear end of the left pivoting member 15 is fitted with a cut or notch 18*a* (see FIG. 33) formed in the left end of the support shaft 18. The right pivoting member 16 also has a rear end fitted with a left cut or notch 18*b* of the support shaft 15. When the left pivoting member 15 is in the engagement position, the first and second abutting walls 15*d* and 15*e* correspond to the first and second switching cams 23 and 24 respectively as shown in FIG. 34. However, when the left pivoting member 15 has been switched from the engagement position to the disengagement position, the first abutting wall 15*d* slides upward and leftward along the inclined cam of the first switching cam 23 as shown in FIG. 38. The support cam 25 is usually in abutment with the left engagement arm 15*a* even when the left pivoting member 15 is in the engagement or disengagement position. More specifically, when the left pivoting member 15 is in the engagement position, the left engagement arm 15*a* and the left side plate 11E are in parallel to each other such that the left engagement pin 15*b* is fitted into the left engagement hole 3*g* of the presser foot 3, as shown in FIG. 31. However, when the left pivoting member 15 has been switched to the disengagement position, the distal end o the left engagement arm 15*a* is open horizontally outward (leftward) relative to the left pivoting member 15 as shown in FIG. 39.

As obvious from the foregoing, the paired engagement pins 15*b* and 16*b* are usually in the engagement positions where the engagement pins 15*b* and 16*b* are in engagement with the paired engagement holes 3*g* and 3*h* respectively. The swing supporting mechanism 7E comprises the pivoting members 15 and 16 and engagement pins 15*b* and 16*b*. Furthermore, the disengaging mechanism 8E comprises the pivoting members 15 and 16.

Figure 37:
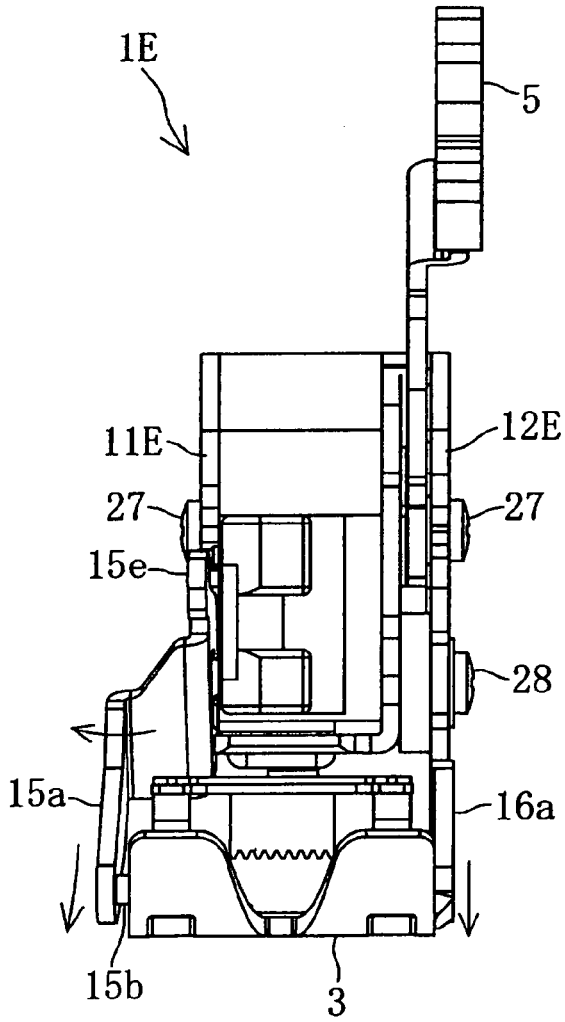
FIG. 37 is a front view of the sewing machine walking foot in the case where the presser foot is replaced by another.

The following describes the operation of the walking foot 1E constructed as described above. As shown in FIGS. 35 to 37, when replacing the presser foot 3 by another in quilting, the operator firstly switches the right and left pivoting members 15 and 16 to the disengagement positions simultaneously. In this case, the distal end of the left engagement arm 15*a* is opened horizontally outward by the cam mechanism 17 as described above (see FIG. 39). More specifically, the distal end of the left engagement arm 15*a* is moved downward and simultaneously opened outward. As a result, since the distance between the left and right engagement pins 15*b* and 16*b* is increased, the left engagement pin 15*b* is disengaged from the left engagement hole 3*g*, whereupon the presser foot 3 can be detached. The operator then prepares another presser foot 3*g* to be replaced by the detached one. The operator firstly fits the right engagement pin 16*b* into the right engagement hole 3*h* of the presser foot 3. The operator then causes the left and right pivoting members 15*b* and 16*b* to pivot to the original engagement positions while causing the left engagement hole 3*g* of the presser foot 3 to correspond to the left engagement pin 15*b*. As a result, the left engagement pin 15*b* is fitted in the left engagement hole 3*g*, whereby the replacement of the presser foot 3 is completed.

As obvious from the foregoing, the supporting member 2E includes the left and right pivoting members 15 and 16 having the left and right engagement pins 15*b* and 16*b* on the distal ends and the left and right side plates 11E and 12E on which the left and right pivoting members 15 and 16 are pivotally mounted, respectively. The disengaging mechanism 8E includes the cam mechanism 17 which renders the left engagement pin 15*b* movable horizontally outward when the left and right pivoting members 15 and 16 are caused to pivot downward. The disengaging mechanism 8E is constructed so that the left engagement pin 15*b* is switched from the engagement position to the disengagement position by the cam mechanism 17. Consequently, the operator can detach the presser foot 3 easily and quickly from the supporting member 2E with interposition of the disengaging mechanism 8E and the cam mechanism 17 when only causing the left and right pivoting members 15 and 16 to pivot downward.

Furthermore, the cam mechanism 17 includes the cams 23 to 25 which hold the left engagement pin 15*b* so that the left engagement pin 15*b* is disallowed to be moved horizontally outward from the left engagement hole 3*g*. Accordingly, when the operator causes the pivoting members 15 and 16 to pivot upward such that the left engagement pin 15*b* is switched to the engagement position, the left engagement pin 15*b* is engaged with and held by the left engagement hole 3*g* and the presser foot 3 can reliably be held by the supporting member 2E.

Additionally, the supporting member 2E is provided with the locking portions 11*f* and 12*f* locking the engagement pins 15*b* and 16*b* of the pivoting members 15 and 16 so that the engagement pins 15*b* and 16*b* are prevented from upward movement from the engagement positions, respectively. Consequently, both engagement pins 15*b* and 16*b* can reliably be held at the engagement positions even during the sewing operation and accordingly, the presser foot 3 can perform its cloth pressing function sufficiently, thereby resulting in no trouble in the sewing operation.

Another cam mechanism 17 may also be provided at the right side so that the right engagement arm 16*a* is horizontally opened. Furthermore, only the right cam mechanism 17 may be provided with the left cam mechanism 17 being eliminated. Furthermore, the rear end of the left pivoting member 15 may be urged by a spring so as to be brought to the interior of the holder 10 so that the left engagement pin 15*b* of the left pivoting member 15 is opened outward when the left pivoting member 15 is caused to pivot into the disengagement position.

The foregoing description and drawings are merely illustrative of the principles of the present disclosure and are not to be construed in a limiting sense. Various changes and modifications will become apparent to those of ordinary skill in the art. All such changes and modifications are seen to fall within the scope of the disclosure as defined by the appended claims.

What is claimed is:

1. A walking foot for a sewing machine including a needle-bar movable vertically, the walking foot being detachably attached to a lower end of a presser bar and comprising:

a presser foot provided with a pair of right and left engagement supported portions;

an upper feed dog feeding workpiece cloth in synchronization with vertical movement of the needlebar;

a supporting member fixed to the lower end of the presser bar and provided with a pair of right and left engagement supporting portions supporting the presser foot;

a swing supporting mechanism which engages the engagement supporting portions of the supporting member with the engagement supported portions of the presser foot from horizontally outside respectively so that the presser foot is supported on the supporting member so as to be swingable; and a disengaging mechanism which moves at least one of the engagement supporting portions horizontally outward from an engagement position where said at least one engagement supporting portion is in engagement with the engagement supported portion of the presser foot, thereby being capable of switching said at least one engagement supporting portion to a disengagement position where said at least one engagement supporting portion is disengaged from the supported portion of the presser foot.

2. The walking foot according to claim 1, wherein the swinging support mechanism includes at least one screw serving as the engagement supporting portion and an engagement hole serving as the engagement supported portion with which the screw engages, and the disengaging mechanism switches the screw from the engagement position to the disengagement position-by turning the screw.

3. The walking foot according to claim 2, wherein the supporting member includes at least one lever member having a distal end provided with the engagement supporting portion, a fulcrum provided in a lengthwise middle thereof, a proximal end formed with an operating portion and a side plate supporting the lever member at the fulcrum so that the lever member is swingable, and the disengaging mechanism is constructed so that when the operating portion has been pressed to the side plate side, the engagement supporting portion is switched via the fulcrum from the engagement position to the disengagement position.

4. The walking foot according to claim 1, wherein the supporting member includes at least one lever member having an engagement pin provided on a distal end thereof and serving as the engagement supporting portion, a fulcrum provided in a lengthwise middle thereof, a proximal end formed with an operating portion and a side plate supporting the lever member at the fulcrum so that the lever member is swingable, and a side plate supporting the fulcrum and having a holding hole into and with which the engagement pin is insertable and engageable, and the disengaging mechanism is constructed so that when the operating portion has been pressed to the side-plate side, the engagement pin is switched via the fulcrum from the engagement position to the disengagement position.

5. A walking foot for a sewing machine including a needlebar movable vertically, the walking foot being detachably attached to a lower end of a presser bar and comprising:

a presser foot provided with a pair of engagement supported portions;

an upper feed dog feeding workpiece cloth in synchronization with a vertical movement of the needlebar;

a supporting member fixed to the lower end of the presser bar and provided with a pair of engagement supporting portions supporting the presser foot;

a swing supporting mechanism which engages the engagement supporting portions of the supporting member with the engagement supported portions of the presser foot from horizontally outside respectively so that the presser foot is supported on the supporting member so as to be swingable; and a disengaging mechanism capable of switching at least one of the engagement supporting portions from an engagement position where said at least one engagement supporting portion is in engagement with the engagement supported portion of the presser foot to a disengagement position where said at least one engagement supporting portion is disengaged from the engagement supported portion of the presser foot.

6. The walking foot according to claim 5, wherein the supporting member includes a pivoting member having a distal end provided with the engagement supporting portion and a side plate on which the pivoting member is pivotally mounted, and the disengaging mechanism causes the pivoting member to pivot to switch the pivoting member from the engagement position to the disengagement position.

7. The walking foot according to claim 6, wherein the supporting member includes a locking member locking the engagement supporting portion of the pivoting member so that the engagement supporting portion is prevented from pivoting over the engagement position.

8. The walking foot according to claim 5, wherein the supporting member includes a pair of pivoting members having distal ends provided with the engagement supporting portions respectively and a side plate on which the pivoting members are pivotally mounted, and the disengaging mechanism has a cam mechanism which allows either pivoting member to move horizontally outward when the pivoting members are caused to pivot downward, the cam mechanism switching said either pivoting member from the engagement position to the disengagement position.

9. The walking foot according to claim 8, wherein the supporting member includes a locking member locking the engagement supporting portion of the pivoting member so that the engagement supporting portion is prevented from pivoting over the engagement position.

10. The walking foot according to claim 8, wherein the cam mechanism has a cam portion holding the engagement supporting portion so that the engagement supporting portion is disallowed to move horizontally from the engagement supported portion when the engagement supporting portion assumes the engagement position.

11. The walking foot according to claim 10, wherein the supporting member includes a locking member locking the engagement supporting portion of the pivoting member so that the engagement supporting portion is prevented from pivoting over the engagement position.

* * * * *